US005487296A

United States Patent [19]

Gerhart et al.

[11] Patent Number: 5,487,296

[45] Date of Patent: Jan. 30, 1996

[54] UNIVERSAL CAM UNIT

[75] Inventors: Roland T. Gerhart, Milford; Erich D. Fidziukiewicz, Canton, both of Mich.

[73] Assignee: Connell Limited Partnership, Boston, Mass.

[21] Appl. No.: 158,613

[22] Filed: Nov. 29, 1993

Related U.S. Application Data

[63] Continuation-in-part of Ser. No. 819,347, Jan. 9, 1992, Pat. No. 5,269,167.

[51] Int. Cl.[6] ..... B21D 5/04

[52] U.S. Cl. ..... 72/381; 72/304; 72/315; 72/452.9; 83/635

[58] Field of Search ..... 72/313, 314, 315, 72/304, 381, 383, 452; 83/588, 627, 635

[56] References Cited

U.S. PATENT DOCUMENTS

| | | | |
|---|---|---|---|
| 4,044,592 | 8/1977 | Carrieri et al. | 72/462 |
| 4,139,090 | 2/1979 | Nelsen | 198/740 |
| 4,259,052 | 3/1981 | Imanishi et al. | 425/135 |
| 4,323,151 | 4/1982 | Andrews | 198/740 |
| 4,436,199 | 3/1984 | Baba et al. | 198/750 |
| 4,471,644 | 9/1984 | Kimbell et al. | 72/405 |
| 4,471,680 | 9/1984 | Gerhart | 83/588 |
| 4,487,051 | 12/1984 | Iwamoto | 72/312 |
| 4,887,446 | 12/1989 | Maher | 72/22 |
| 5,003,808 | 4/1991 | Maher | 72/405 |
| 5,101,705 | 4/1992 | Matsuoka | 83/588 |
| 5,269,167 | 12/1993 | Gerhart | 72/381 |

FOREIGN PATENT DOCUMENTS

| | | |
|---|---|---|
| 0202924 | 11/1983 | Japan . |
| 0087933 | 5/1984 | Japan . |
| 0193723 | 11/1984 | Japan . |
| 0137530 | 7/1985 | Japan . |
| 0263824 | 11/1987 | Japan . |

OTHER PUBLICATIONS

Degele Manufacturing Inc., products catalogue entitled "DMI Cam Units", printed Jun. 14, 1991.

Degele Manufacturing Inc. , products catalogue entitled "DMI Cam Units", printed Feb. 21, 1992; copyright 1990.

Fisher Body Division of General Motors, die design standards sheets entitled "Cam Die Standards", pp. 9 and 11, printed May 1997.

Ford, die design standards sheets entitled "Die Design and Construction Specifications", pp. 8 and 9, printed Aug. 1990.

General Motors, die design standards sheets entitled "Die Design Standards", pp. 38.31–38.32, printed Nov. 1989.

Sankyo, catalogue entitled "Cam Unit, Flying".

Sankyo, catalogue entitled "Cam Unit, Inclined".

General Motors, die design standards sheets, cover, table of contents, pp. 38.04, 38.10, 38.13, 38.15, 38.17, 38.19, 38.21, 38.23, 38.25, 38.33–38.37, 38.39 and 38.41, printed 1987–1990.

(List continued on next page.)

*Primary Examiner*—David Jones

*Attorney, Agent, or Firm*—Leydig, Voit & Mayer, Ltd.

[57] ABSTRACT

A universal cam unit for use in a power press comprising a driver assembly, a slide block to which the working tool is mounted, and a mounting bracket for coupling the slide block to the ram for movement therewith. The slide block is slidably mounted to move between a retracted and an extended position. The slide block and the driver assembly include parallel inclined bearing surfaces which abut when the pressure pad and the ram are lowered. As the ram motion continues, the inclined bearing surfaces slide against each other thereby causing the slide block to move from the retracted to the extended position. The movement of the slide block brings the tool into engagement with a workpiece disposed between the pressure pad unit and the lower die to perform a desired operation. The components of the universal cam unit may be disassembled and selectively replaced, so that the unit may be quickly and easily adapted for use in a desired application.

30 Claims, 23 Drawing Sheets

OTHER PUBLICATIONS

General Motors, die design standards sheets, pp. 38.00, 38.07, 38.08, 38.11, 38.12, 38.27, 38.29, 38.30 and 38.32, printed 1989–1990.

Fisher Body Division of General Motors, die design standards sheets entitled "Cam Die Standards", pp. 1–3, printed May 1977.

Sankyo Oilless catalogue 1989/1990, front and back covers, pp. 9–10, 15–28, 93–94, 109–111, 135–136, 203–206, 213–214, 241–242; 267–268, 275–276, 341–344, 351–352, and 362–363.

UNIVERSAL CAM UNIT

This patent application is a continuation-in-part of U.S. patent application Ser. No. 07/819,347, filed on Jan. 9, 1992, now U.S. Pat. No. 5,269,167 by Roland T. Gerhart for a UNIVERSAL AERIAL CAM UNIT.

FIELD OF THE INVENTION

This invention relates generally to power press assemblies, and, more particularly, to aerial and base mounted cam units for use in power press assemblies.

BACKGROUND OF THE INVENTION

In the metalworking industry, power presses are often used to form stock material such as steel or sheet metal into a variety of components. For example, in the automotive industry, sheet stock is formed into components of relatively small parts, such as engine struts, as well as significantly larger vehicle body components, such as deck lids, doors, and quarter panels.

Typically, the workpiece is drawn or struck one or more times between upper and lower die halves to form the stock into a desired shape. Due to the particular shape of the article, in many applications, it is necessary to perform an operation on the workpiece at an angle other than with the travel of the press. For example, it may be necessary to punch an opening into or trim flash from the edge of the workpiece. In such situations, the workpiece may be reoriented and/or advanced to another workstation to perform the required operation. Alternately, a separate device may be provided within the particular workstation. Such devices may be actuated once the drawing has been completed, or, alternately, simultaneously with the drawing operation.

"Aerial cam" units are particularly effective devices for performing such auxiliary operations. These cam units are generally associated with the ram of the press. Thus, aerial cam units are suspended above the working area when the press is open and, consequently, do not interfere with the movement of a workpiece through the press. "Base mounted" cam units, however, can likewise perform these functions in an effective manner. Base mounted cam units, in contrast to aerial cam units, are generally secured to the press bed.

While various aerial and base mounted cam devices have been developed, each cam unit is generally unique to the die set, part, and press for which it has been designed. Thus, when the die set or part is changed on a press, the cam unit must likewise be changed. Consequently, a cam unit must be provided for each die set or part utilized in a particular press. The design and construction of unique cam units for use with the various die sets or parts utilized in a particular press is both costly and time consuming. Further, cam units are generally quite large, cumbersome, and heavy. Thus, replacing the unit can be difficult and time consuming, resulting in excessive downtime, high labor costs, and high maintenance costs.

OBJECTS OF THE INVENTION

It is a general object of the invention to provide a universal cam unit which standardizes the design of such cam units utilized in power presses and thereby reduces the costs attendant with the design and construction of unique cam units for each die set. It is an additional object to provide a standard cam unit design that may be adapted for use with more than a single die set.

Another object is to reduce the downtime, labor costs, and maintenance costs associated with die and cam changes and adjustments. It is a related object to provide a cam unit that may be easily and quickly removed from a press, and assembled and disassembled both inside and outside of the press. It is a more specific object to provide a cam unit that is smaller, lighter, and less cumbersome than traditional units. It is a further object to provide a cam unit that may be adjusted to account for wear.

BRIEF SUMMARY OF THE INVENTION

In accomplishing these objectives, an adjustable universal cam unit is provided for a power press having a press bed, a ram, which is movable with respect to the press bed and a pressure pad unit, which is movable with respect to the press bed and the ram. During operation, as the pressure pad lowers toward the press bed, a workpiece is held or formed into a desired part between a lower die and the upper pressure pad unit of the die. When aerially mounted, the universal cam unit includes a stationary driver which is mounted to the press bed, a slide block to which the working tool is mounted, and means for slidably coupling the slide block to the ram for movement with the ram. The slide block is slidably mounted to move transversely to the plane of movement of the ram between an extended position and a retracted position. The driver includes an upper inclined bearing surface and the slide block includes a parallel lower inclined bearing surface. At the initiation of a press cycle, the pressure pad unit and the ram are in their open position in the press and the slide block is disposed in its extended position. As the pressure pad moves to close the die, it dwells, the ram lowers, and the slide block is likewise moved toward the driver. As the ram moves, the lower inclined surface of the slide block seats on the upper inclined surface of the driver. Because the bearing surfaces of the driver and the slide block are inclined at an angle to the plane of motion of the ram, the slide block moves transversely to the plane of motion of the ram. Thus, the slide block moves from the retracted position to the extended position and the working tool moves into engagement with the workpiece to perform a desired operation. It will be appreciated, however, that the unit is preferably mounted such that the travel of the slide block results in the tool engaging the workpiece at a substantially perpendicular angle.

In an alternative embodiment the cam unit is base mounted such that the slide block is slidably coupled to the press bed and the driver is mounted to the ram. As a result, the press cycle described above is changed so that the driver, not the slide block, is lowered with the ram. In all other respects, the cam functions in substantially the same manner when base mounted as when aerial mounted. Thus, the base mounted cam unit enjoys the same ease of assembly and disassembly for maintenance and the like as the aerial mounted cam unit.

According to an important aspect of the invention, the cam unit is comprised of various components that may be adjusted to modify the design of the unit. Further, the unit may be adapted for use in multiples. Consequently, the standardized unit may be adapted for use with substantially any die set.

Further, the cam unit may be easily assembled and disassembled, both inside and out of the press. It is preferably lighter, smaller, and less cumbersome than traditional units. Thus, maintenance functions, such as adjusting the unit to account for wear, may be readily performed in the shop. As a result, labor and maintenance costs, as well as down time are substantially reduced.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 7 is an enlarged view of the aerial cam assembly taken along line 7—7 in FIG, 4.

FIG. 8 is a cross-sectional view of the aerial cam unit taken along line 8—8 in FIG. 7.

FIG. 9 is a cross-sectional view of the aerial cam unit taken along line 9—9 in FIG, 7.

FIG. 10 is a side view of the aerial cam unit in the extreme downward position with cut away to show the relative position of the shock absorbing spring.

FIG. 11 is an enlarged fragmentary view of a lubrication unit taken along line 11—11 in FIG. 7.

FIG. 12 is a cross-sectional side view of an alternate embodiment of the invention.

FIG. 13 is a cross-sectional view of the aerial cam unit taken along line 13—13 in FIG. 12.

FIG. 14 is a cross-sectional side view of an alternate embodiment of the invention partially cut away to show springs.

FIG. 15 is a side view of the aerial cam unit cut away to show elements utilized during alignment of a tool.

FIG. 16 is a cross-sectional view of the aerial cam unit taken along line 16—16 in FIG. 15.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DESCRIPTION OF THE PREFERRED EMBODIMENTS

Figure 1:
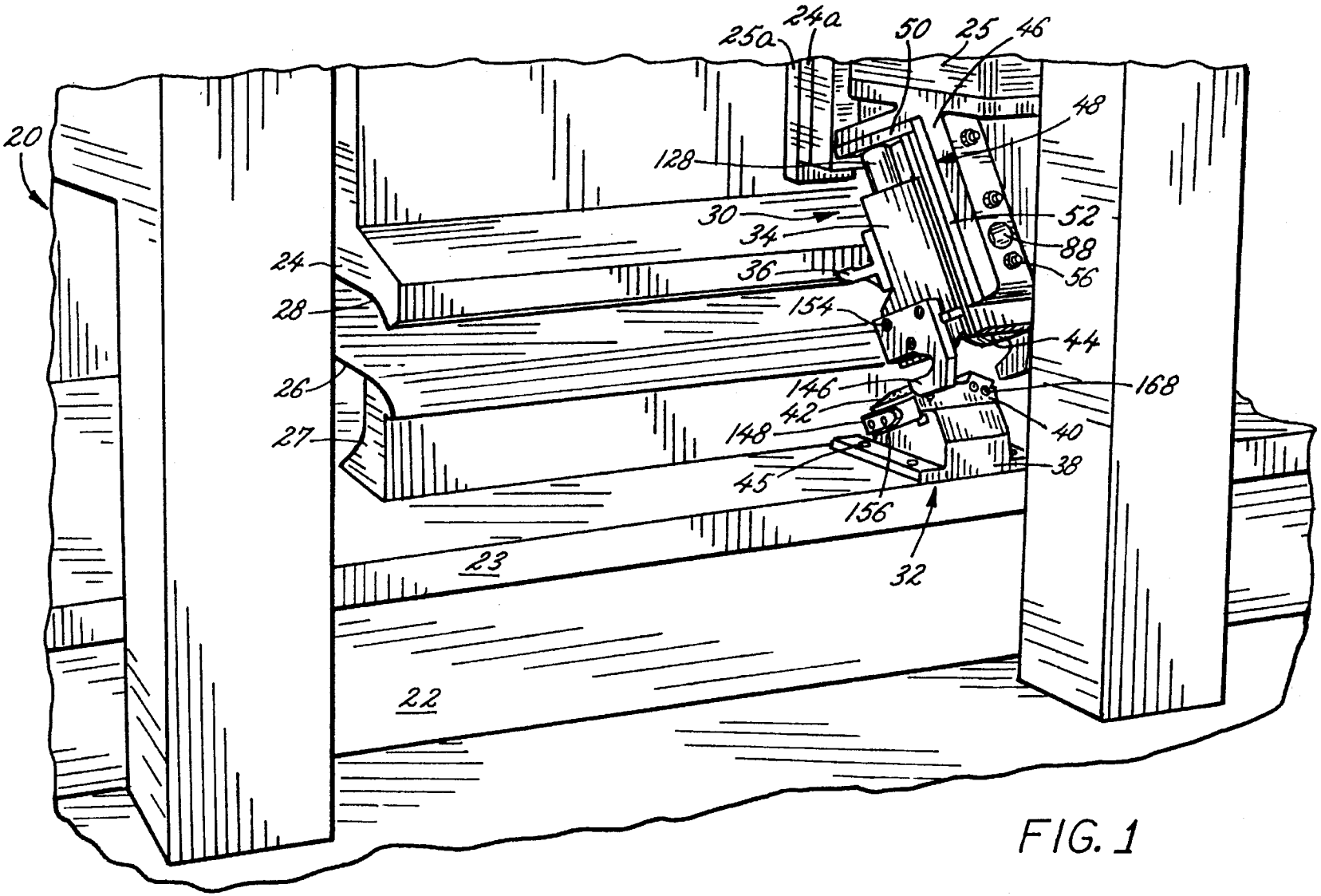
FIG. 1 is a fragmentary perspective view of a power press incorporating a first embodiment of the universal cam assembly constructed according to the present invention.

Turning now to the drawings, there is shown in FIG. 1 a fragmentary view of a power press 20 used for the deformation of material such as steel into a desired part or parts. The power press 20 includes a stationary press bed 22 to which is coupled a lower die shoe or bolster plate 23. Along its upper portion, the power press 20 includes a pressure pad unit 24 and a ram unit 25, which typically move in a vertical direction within the press 20. Wear plates *24a*, *25a* may be provided along adjacent moving surfaces of the pressure pad unit 24 and the ram unit 25 to prevent excessive wear and provide smooth sliding movement. A die set, which is specific to the part or parts being formed, includes a lower die 26 and die post 27 coupled to the lower die shoe 23, and an upper pressure pad unit die 28 with the pressure pad unit 24. Generally, the lower die 26 and the die post 27 are formed as a single unit, and the upper pressure pad unit die 28 and the pressure pad unit 24 are formed as a single unit. It will be appreciated, however, that the respective components may be formed separately, and secured together.

During operation, sheet stock made of steel or the like is advanced into position between the lower die 26 and the pressure pad unit 24. The press 20 is then actuated to lower the pressure pad unit 24 to move the upper pressure pad unit die 28 toward the lower die 26. As the upper pressure pad unit die 28 approaches the lower die 26, the stock may be progressively deformed between the die halves 28, 26. While, in transfer presses, the upper pressure pad unit 24 generally makes only a single hit, it will be appreciated that the invention may likewise be utilized in a press that makes multiple hits, depending upon the stock utilized and the design of the part into which the stock is being formed, as well as the specifications of the press 20 itself.

Figure 2:
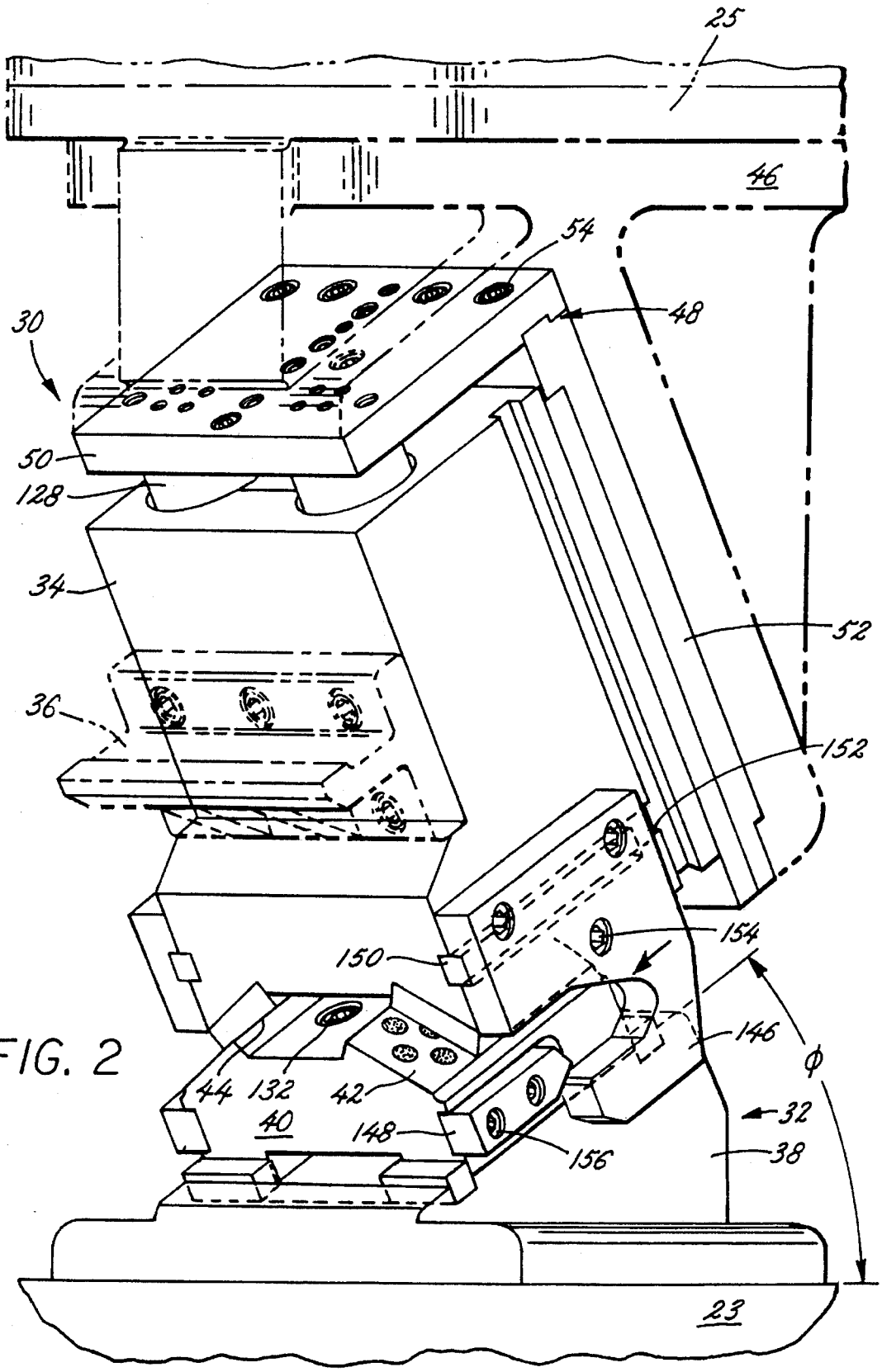
FIG. 2 is an enlarged perspective view of the aerial cam assembly of FIG. 1.
Figure 7:
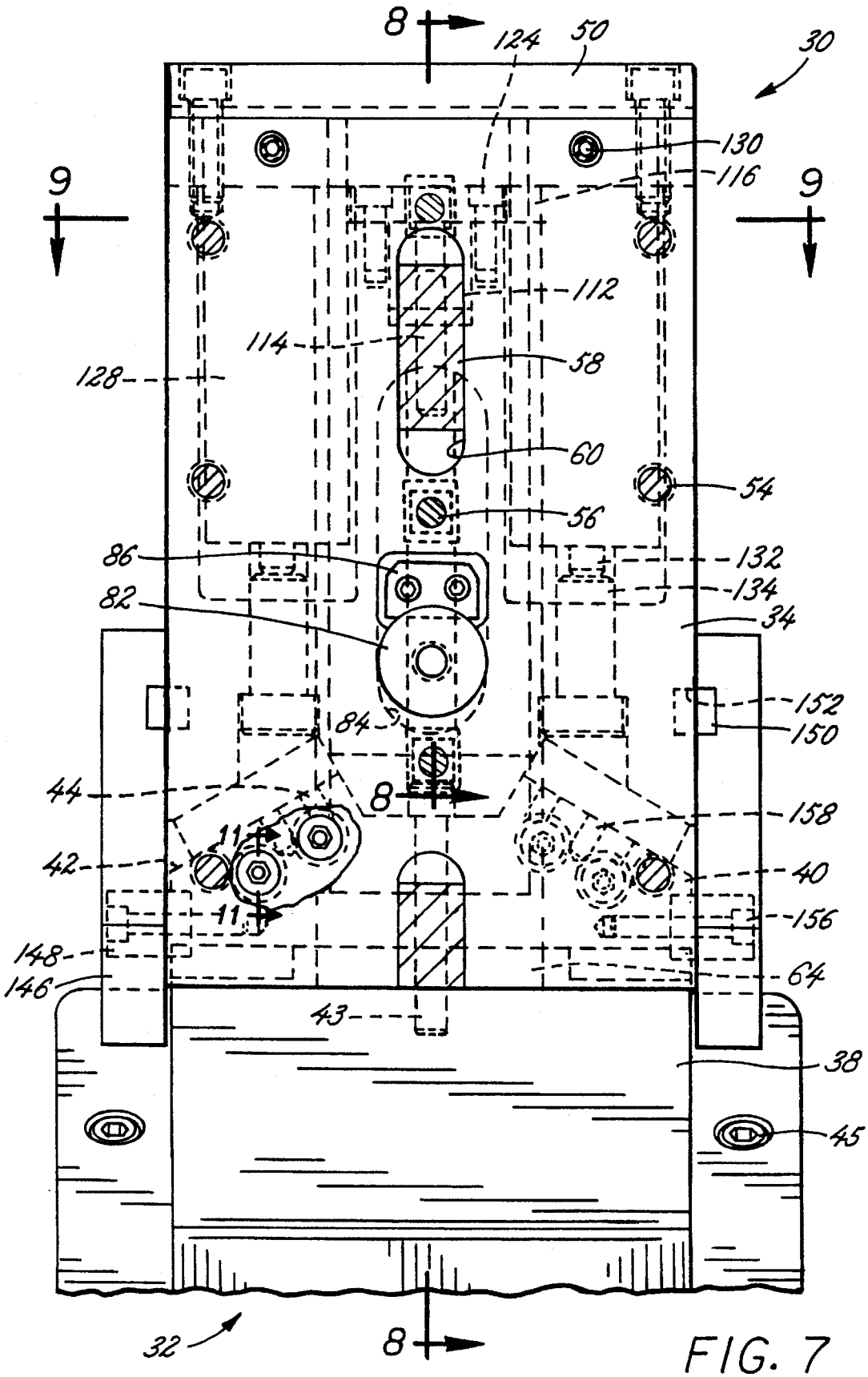

In accordance with the invention, there is provided a universal cam unit 30 for performing additional operations such as cutting, punching, folding, and flanging, on the workpiece. Although the unit 30 and its operation will be described with reference to a press 20 in which the pressure pad unit 24 and the ram 25 unit move in a vertical direction, the invention is likewise applicable to a press wherein the pressure pad unit and the ram move at some angle to the vertical. It will likewise be appreciated that, if the user prefers, the cam unit can also be base mounted such that the relative vertical position of the slide block 34 and the driver assembly 32 is reversed without departing from the invention. The aerially mounted universal cam unit 30, which is shown in greater detail in FIG. 2, comprises a driver assembly 32 and a slide block 34 to which a tool 36 is secured for performing a desired operation on the workpiece. While the invention will be explained with reference to a cutter used for trimming operations, it will be appreciated that a punch or other tool would likewise be suitable. While the specific design of the driver assembly may vary, in the embodiment shown, the driver assembly 32 includes a driver base 38 to which is secured a driver block 40 having an upper inclined bearing surface 42, the driver block 40 being secured to the driver base 38 by bolts 43. The driver base 38 is mounted to the lower die shoe 23 by bolts 45 to prevent relative movement (as shown in FIGS. 1 and 7). According to another aspect of the invention, the slide block 34 includes an inclined lower surface 44 which is disposed parallel to the inclined upper surface 42 of the driver assembly 32. It will be appreciated that the upper inclined surface 42 of the driver assembly 32 and the lower inclined surface 44 of the slide block 34 may be of any appropriate design and angle θ, so long as the surfaces remain substantially parallel. In the first illustrated embodiment, the inclined surfaces 42, 44 are of a substantially inverted U-shape, disposed at approximately a 30° angle to the horizontal plane. Preferably, the die designer chooses the angle θ of the driver assembly 32 to provide a substantially perpendicular motion of the cutting steel or tool 36 relative to the die 26 and die post 27, as the slide block 34 moves relative to the ram 25, as explained below.

The slide block 34 is coupled to the ram unit 25 for vertical movement therewith so that as the ram unit 25 is lowered, the slide block 34 is likewise lowered toward the driver assembly 32. In this embodiment, the slide block 34 is disposed in a plane at an angle to the vertical and is mounted to slide at an angle to the vertical within that plane between an uppermost position and a lowermost position. For the purposes of explanation, the uppermost position of the block 34, i.e. nearest to the ram 25 may be identified as the retracted position, while the lowermost position, i.e. most distant from the ram 25, may be identified as the extended position. It will be appreciated that when the press 20 is open, the slide block 34 will generally be disposed in the extended position due to the force of gravity and the nitrogen-filled cylinders 128 (as will be explained in greater detail below), as substantially shown in FIG. 3. Conversely, when the ram 25 is in its lowermost position and the slide block 34 is caused to move toward the ram 25, the slide block 34 will generally be disposed in its retracted position, as substantially shown in FIG. 6.

Figure 3:
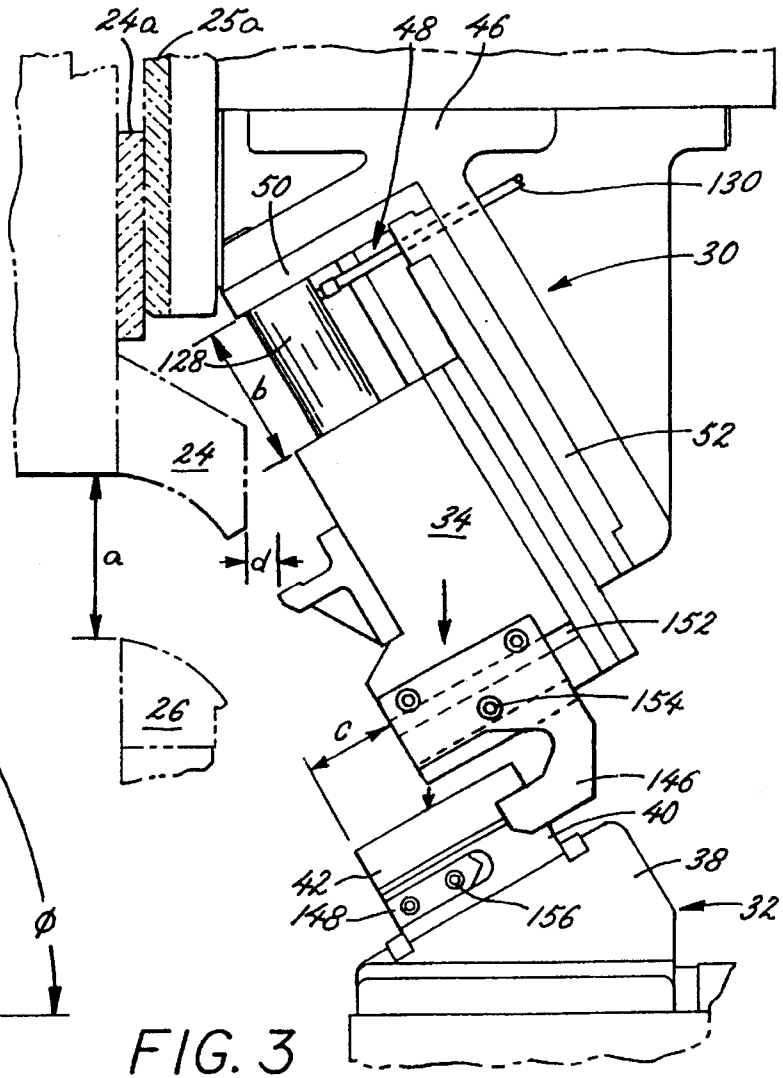
FIGS. 3–16 are fragmentary side views of the power press of FIG. 1 showing the ram progressing in the downward direction.
Figure 4:
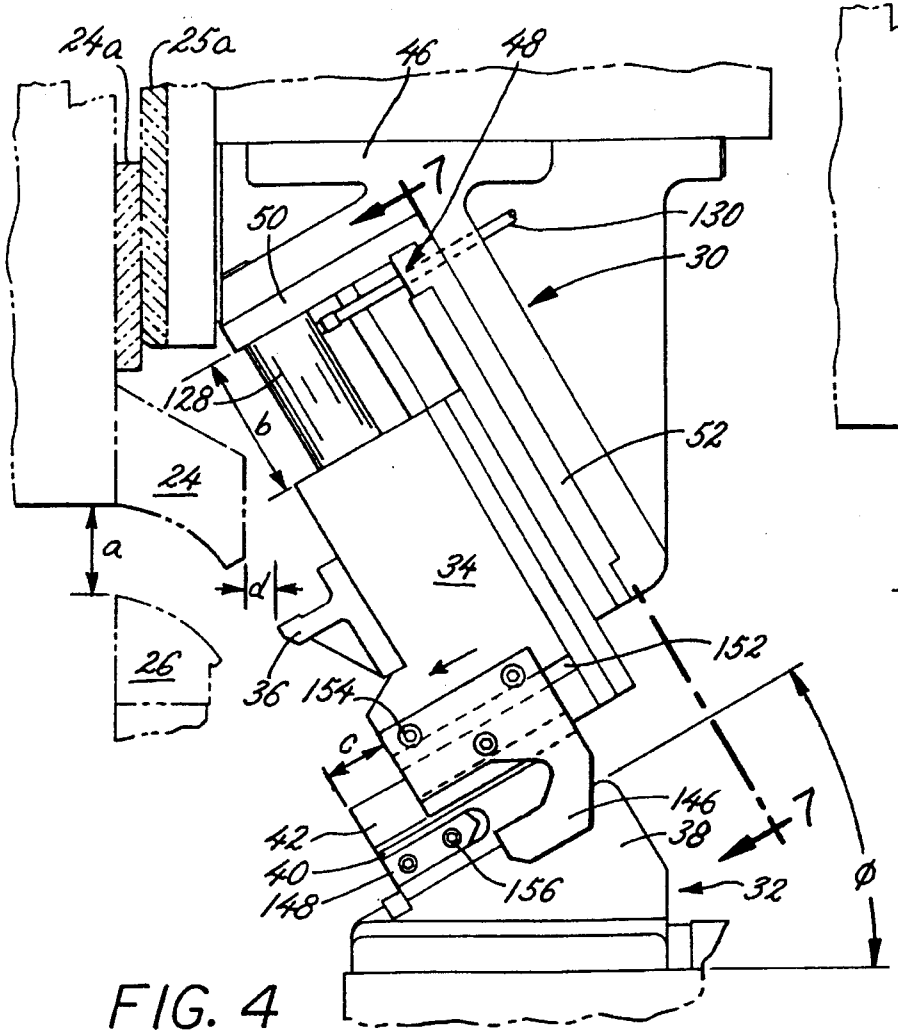
Figure 5:
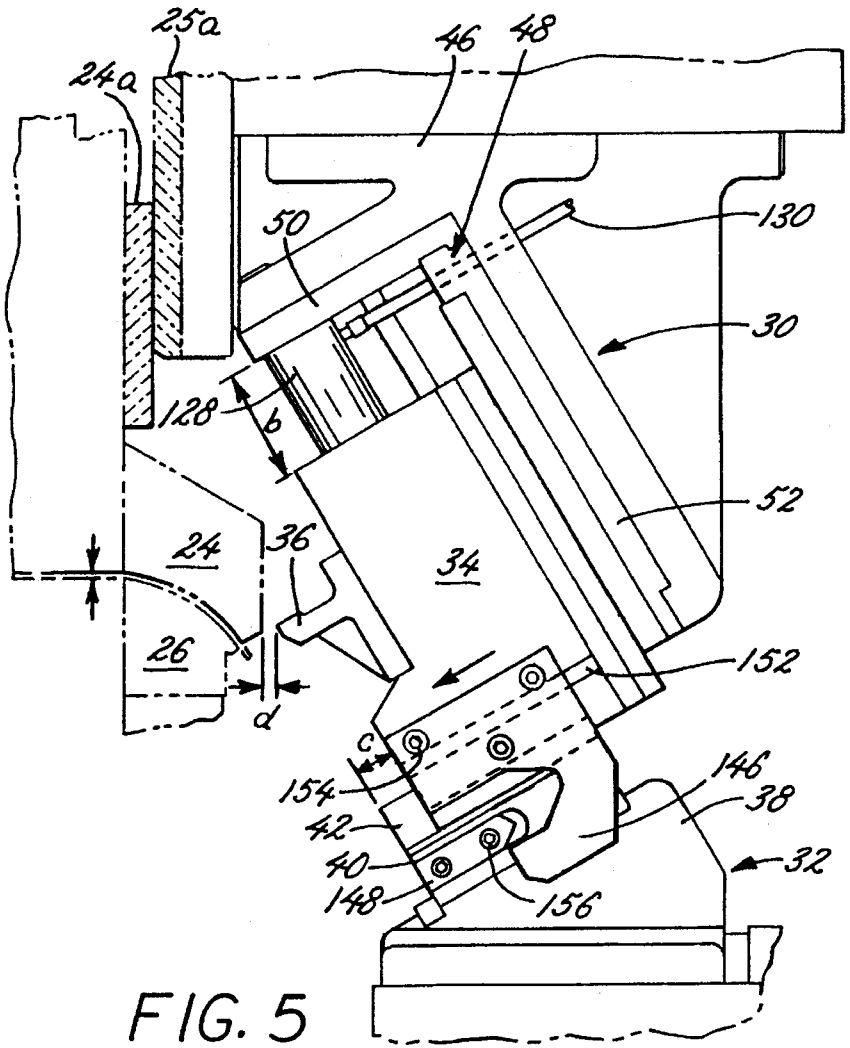
Figure 6:
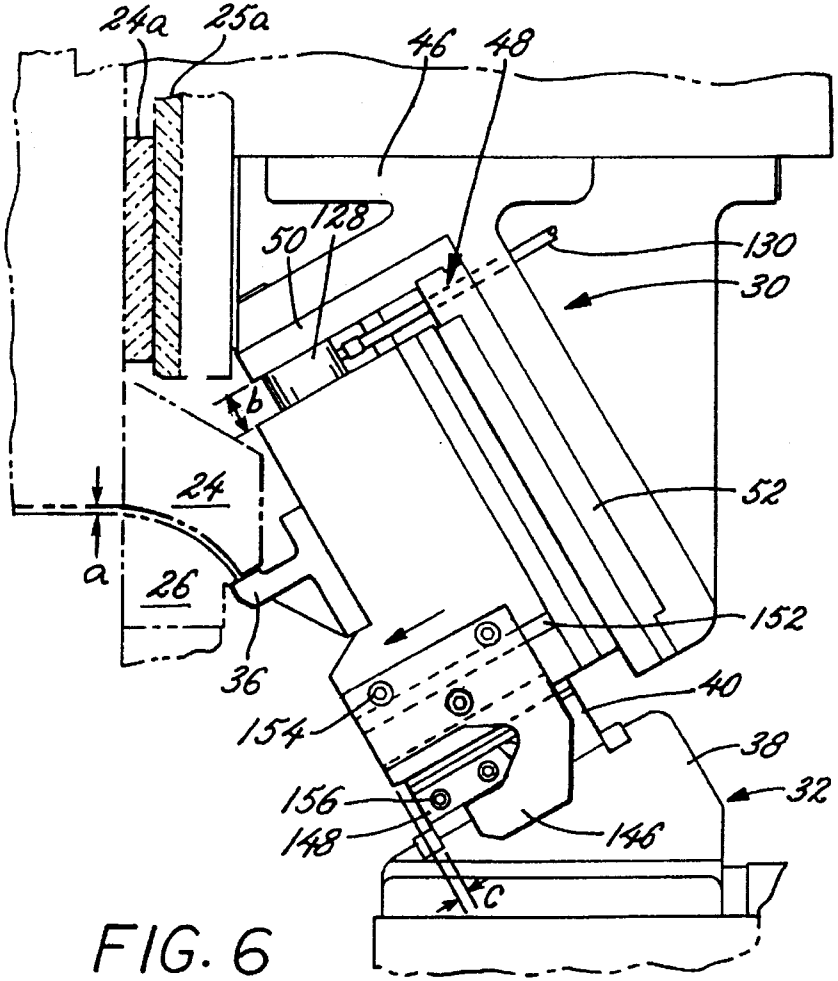

As shown in FIGS. 3–6, as the ram unit 25 and the pressure pad unit 24 lower during operation (distance "a" decreases), the pressure pad unit 24 is compressed against the lower die 26 and die post 27 to perform an operation on the stock, or merely hold the stock in place. Further, as the ram unit 25 is lowered, the slide block 34 is lowered therewith. As the slide block 34 is lowered, the inclined lower surface 44 of the slide block 34 contacts the upper inclined surface 42 of the driver assembly 32 (as shown in FIGS. 3 and 4). As the ram unit 25 proceeds downward, slide block 34 slides upward relative to the ram unit 25 as the inclined lower surface 44 of the slide block 34 slides downward along the inclined upper surface 42 of the driver assembly 32 (distances "b" and "c" decrease, as shown in FIGS. 4–6).

Inasmuch as the slide block 34 is slidably mounted at an angle to the plane of movement of the ram unit 25, the upward sliding movement of the slide block 34 will have both a component substantially parallel to the movement of the ram unit 25 and a component substantially transverse to the movement of the ram unit 25. Thus, as the slide block 34 slides upward relative to the ram unit 25, it likewise slides inward toward the workpiece situated between the pressure pad unit 24 and the lower die post 27 to perform the desired operation on the workpiece (distance "d" decreases).

On the return stroke, as the ram unit 25 moves upward in the press 20, slide block 34 slides downward relative to the ram unit 25 (distance "b" increases), and the inclined lower surface 44 of the slide block 34 slides upward and outward on the inclined upper surface 42 of the driver assembly 32 (distance "c" increasing) to disengage the tool 36 from the workpiece (distance "d" increasing). As the ram unit 25 continues in the upward direction, the slide block 34 separates from the driver assembly 32. Thus, it will be appreciated that the aerial cam unit 30 will not interfere with movement of the workpieces and stock through the press 20 itself as it provides ample room for any transfer mechanisms to operate freely and without cam interference.

Returning now to FIG. 2, the slide block 34 is mounted to the ram unit 25 by means of an L-shaped upper mounting bracket 46, which is secured to the ram unit 25 for movement therewith. In order to couple the slide block 34 to the mounting bracket 46, the aerial cam unit 30 is provided with a mating L-shaped back plate 48. In the first exemplified embodiment, the back plate 48 is formed of two mating components, a top plate 50 and a rear plate 52, and is secured to the mounting bracket 46 by means of bolts 54, 56 (shown in detail in FIGS. 7–9).

In order to assist in positioning the back plate 48 on the mounting bracket 46 and securing the components together, the mounting bracket 46 is provided with an elongated key 58 and the back plate 48 provided with a corresponding keyway 60. During assembly, the keyway 60 of the back plate 48 is positioned over the key 58 extending outward from the bracket 46. The safety through bolts 56 and bolts 54 are then inserted through the provided bores and tightened to secure the back plate 48 (and the T-gib, as explained below) to the bracket 46. It will thus be appreciated that back plate 48 may be easily assembled to, and removed from, the upper mounting bracket 46.

Figure 8:
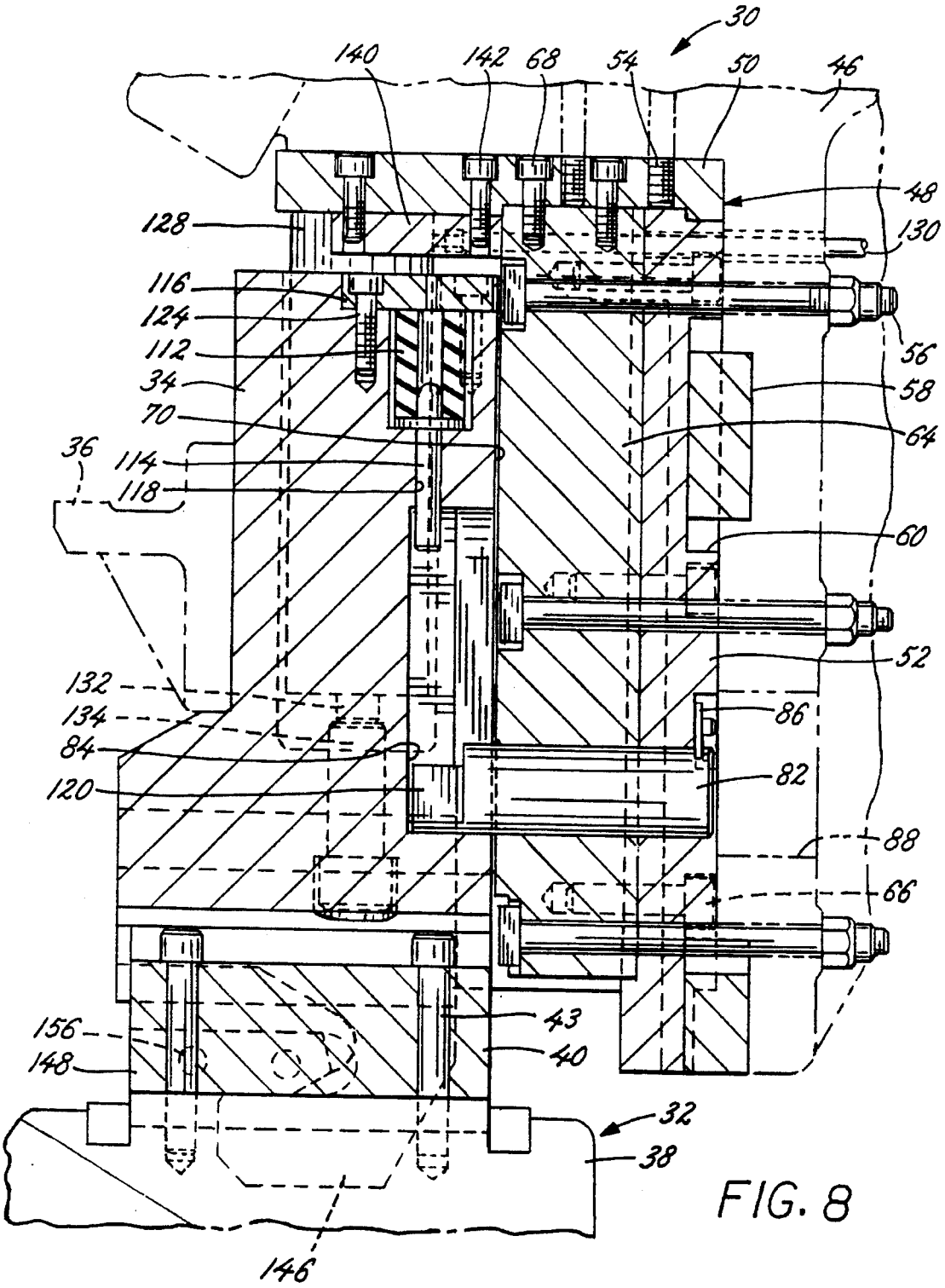
Figure 9:
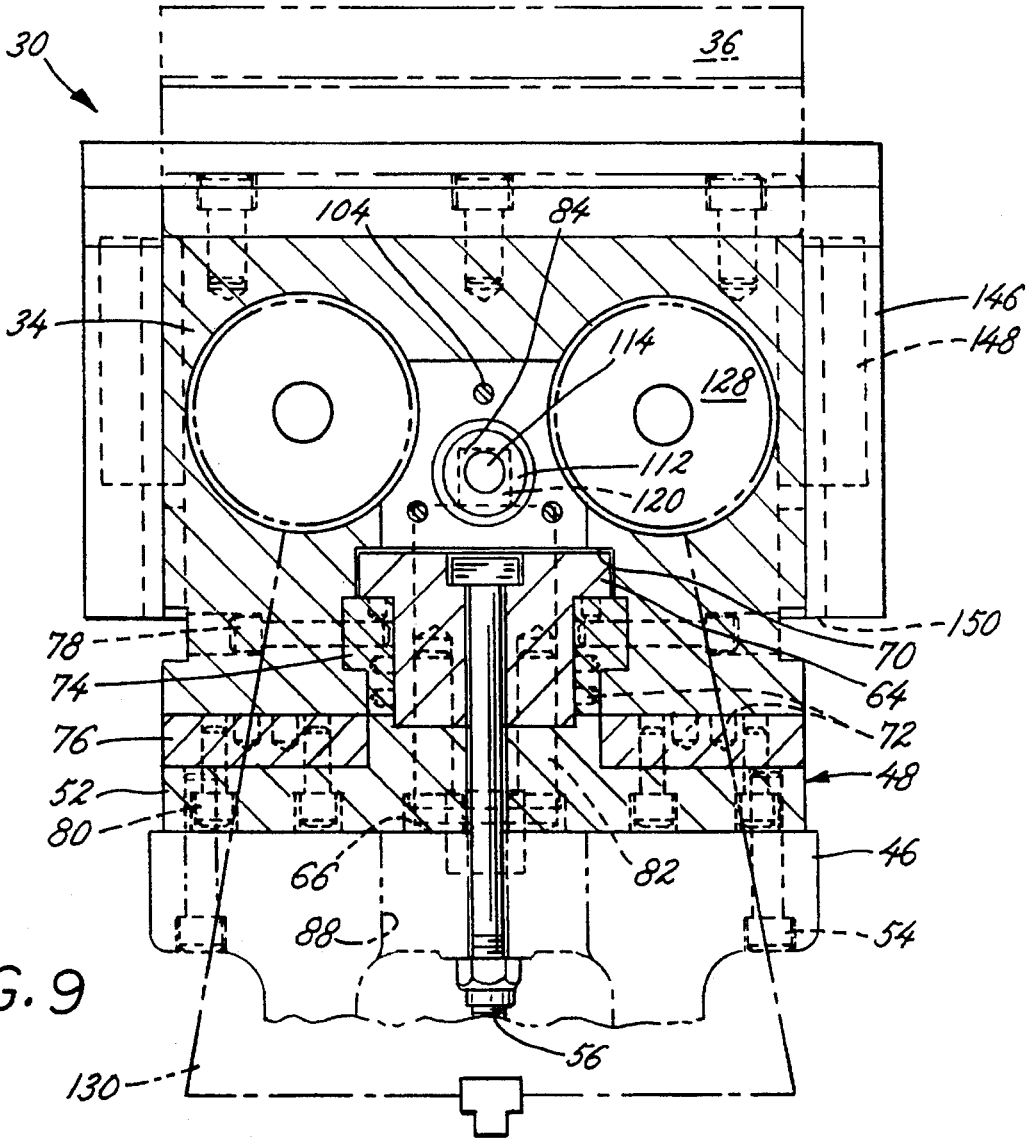

In the embodiment shown in FIGS. 7–9, the slide block 34 is slidably coupled to the back plate 48 and, therefore, the ram unit 25 by means of a T-gib assembly. The T-gib assembly includes an elongated T-gib 64 which is secured to the rear plate 52 by bolts 66 and the top plate 50 by means of bolts 68. (It will be appreciated that safety through bolts 56 are assembled through the T-gib 64 and the rear plate 52 when mounted to the mounting bracket 46.) As best seen in FIG. 9, the slide block 34 is formed with a mating opening 70 to provide sliding movement of the slide block 34 along the T-gib 64.

In order to provide for smooth sliding of the components, lubrication is provided to the mating surfaces by means of solid lubricant plugs 72 disposed in replaceable insets 74, 76 in both the slide block 34 and the rear plate 52, respectively (shown in FIG. 9). In the first illustrated embodiment, the plugs 72 are fabricated from a graphite material. It will be appreciated, however, that the plugs 72 could be fabricated from another appropriate material, or lubrication may be provided by an alternate means if so desired. As shown in FIG. 9, the insets 74 are secured to the slide block 34 by means of bolts 78 and the insets 76 secured to the back plate 52 by bolts 80. Thus, it will be appreciated by those skilled in the art that the coupling means, i.e. the sliding components of the slide block 34 and rear plate 52, may be easily replaced or adjusted.

In order to limit the sliding movement of the slide block 34 along the T-gib 64, a stop pin 82 is provided. In the embodiment shown, the stop pin 82 is secured to the rear plate 52 and the T-gib 64 and extends into an elongated opening 84 in the slide block 34. In this way, the stop pin 82 limits the sliding movement of the slide block 34 to define the extended position of the slide block 34 when the slide block 34 is in the extreme downward position.

According to an aspect of the invention, the stop pin 82 may be easily replaced. The stop pin 82 is secured to the rear plate 52 and the T-gib 64 by a retaining plate 86. In order to provide easy access to the retaining plate 86 and stop pin 82, the mounting bracket 46 is provided with an access opening 88, as shown in FIG. 1. In this way, the stop pin 82 may be removed to permit the slide block 34 to be slid downward on the T-gib 64 and removed for clearance adjustment or other maintenance while the die is in the press 20.

Figure 12:
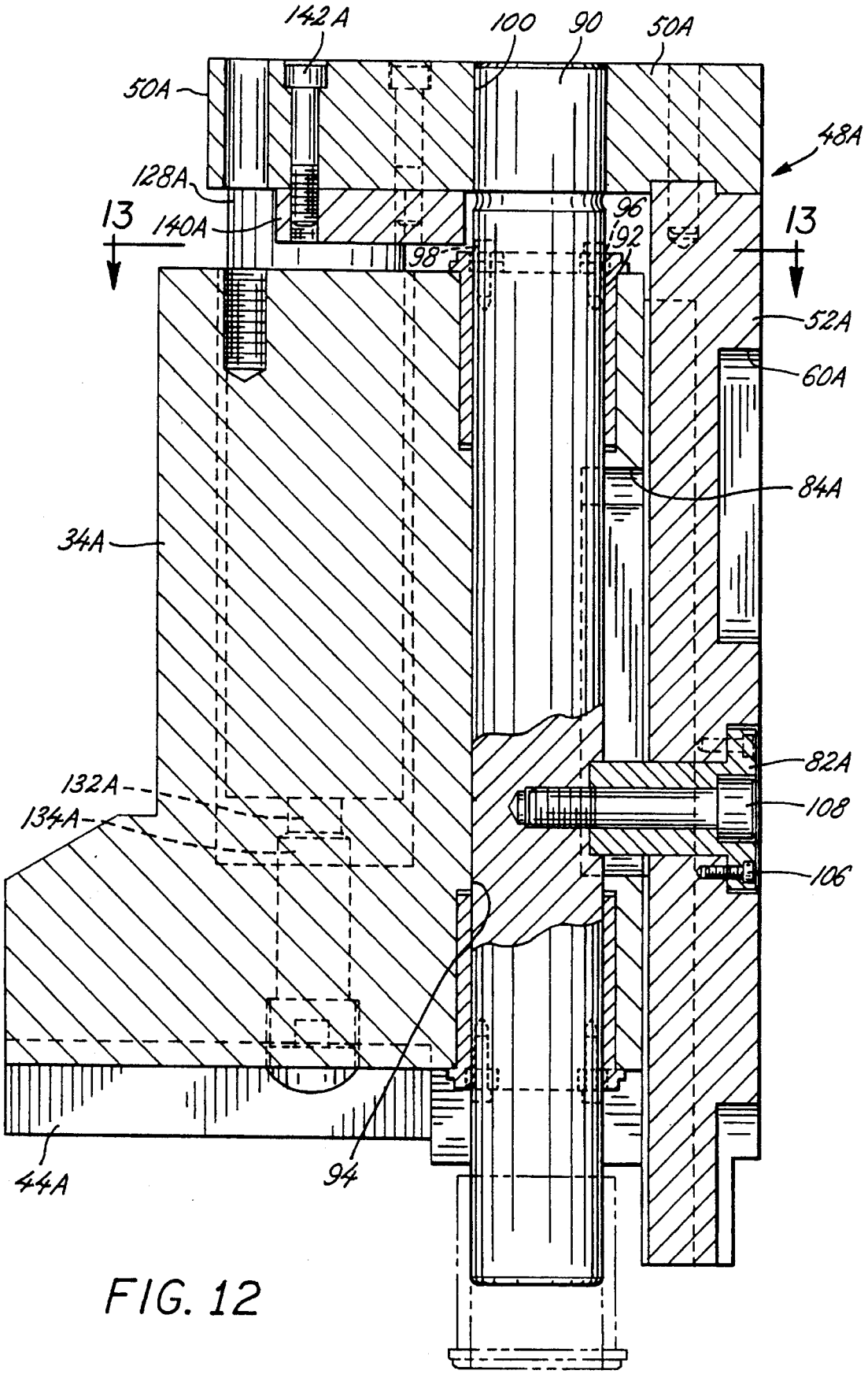
Figure 13:
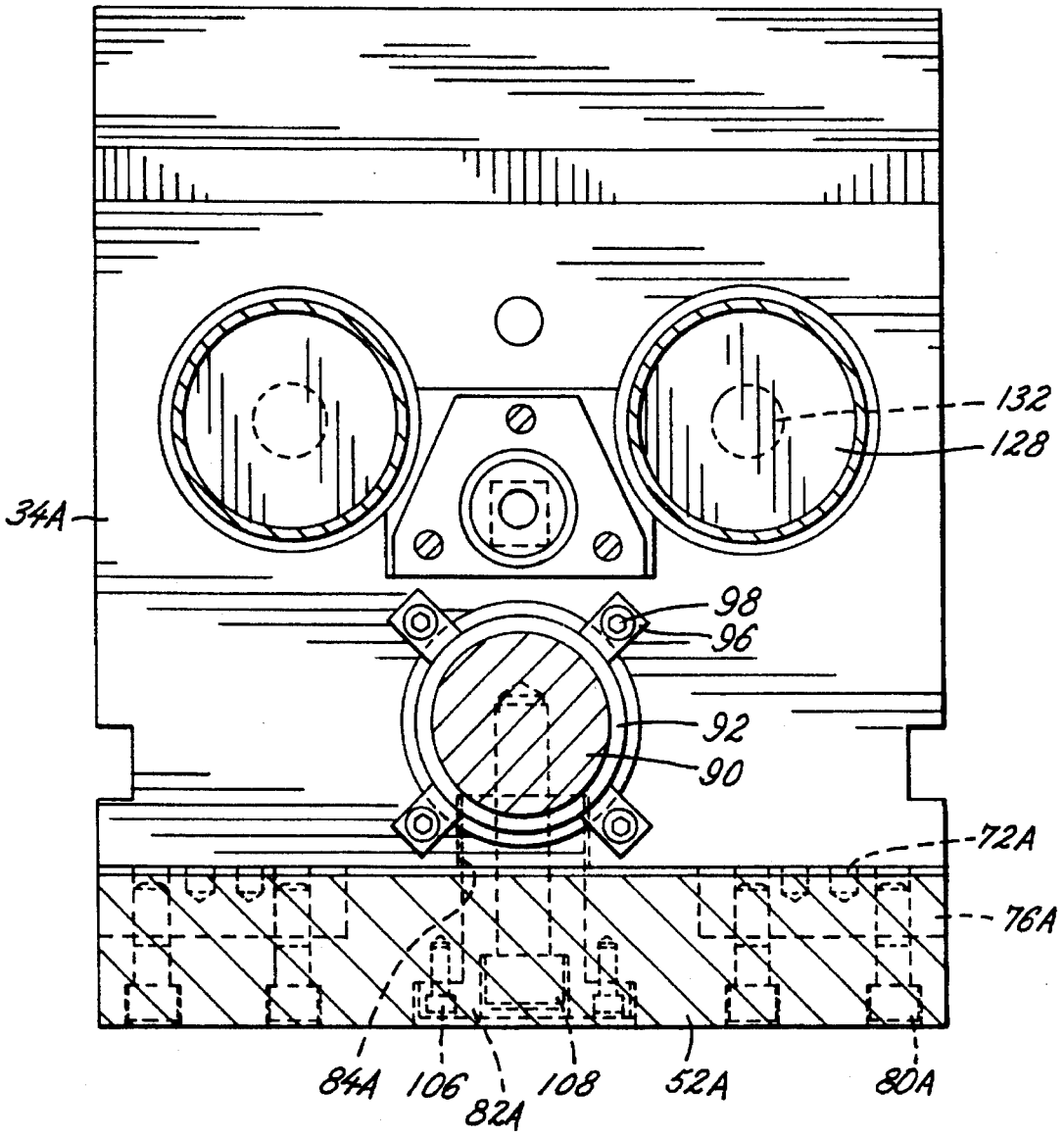

Although the first illustrated embodiment utilizes a T-gib to slidably couple the slide block to the back plate, it will be appreciated that the units could be slidably coupled by any alternate appropriate means. For example, a guide pin 90 and slide bushing 92 arrangement could likewise be utilized, as shown in FIGS. 12 and 13. (The components of the device shown in FIGS. 12 and 13 have been designated with the same numbers as those utilized in the first illustrated embodiment followed by the letter "A".) In order to provide the sliding movement, the slide block 34A is provided with an internal bore 94 through which the guide pin 90 is slidably disposed. The guide pin 90 is secured to the back plate 48A.

In order to provide smooth sliding movement of the slide block 34A along the guide pin 90, slide bushings 92 are provided at the upper and lower ends of the internal bore 94. While a suitable lubricant may be provided between the bushings 92 and the internal bore 94, the bushings 92 are preferably fabricated from a low friction material, such as aluminum-bronze. In the embodiment shown, the bushings 92 are coupled to the slide block 34A by bushing clamps 96, which are secured to the slide block 34A by screws 98.

In order to secure the guide pin 90 to the back plate 48A, an opening 100 is provided in the top plate 50A, into which the guide pin 90 is inserted; also provided is a stop pin 82A, which serves the functions of both further securing the guide pin 90 to the rear plate 52A and limiting the sliding movement of the slide block 34A. The stop pin 82A is secured to the rear plate 52A by screws 106, and to the guide pin 90 by screw 108. In order to limit the travel of the slide block 34A and define the extended and retracted positions of the slide block 34A, an elongated opening 84A is provided in the slide block 34A. It will thus be appreciated that the sliding movement of the slide block 34A may be defined by the guide pin 90 and slide bushings 92 and related components as described above.

Figure 10:
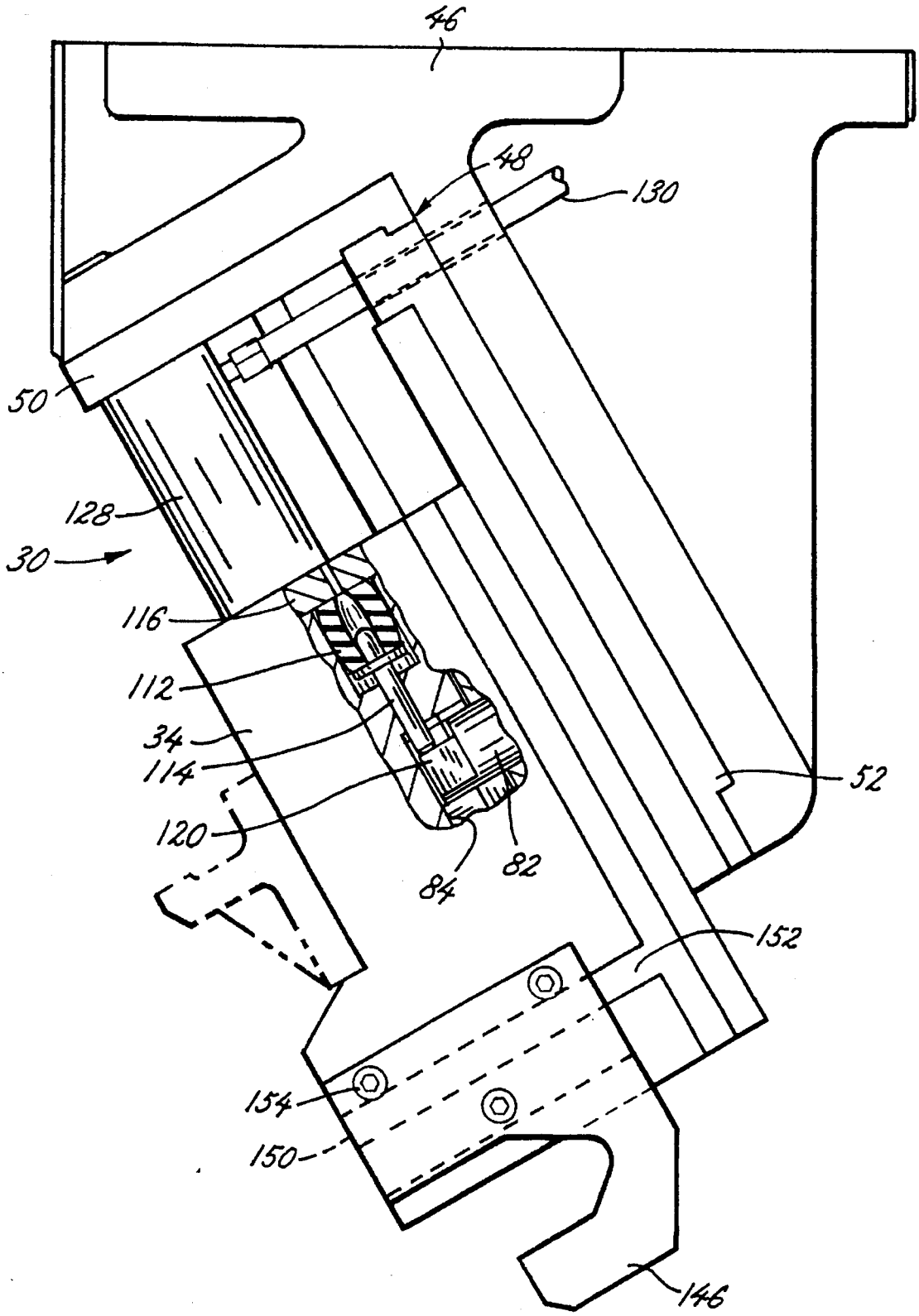

Returning now to the first illustrated embodiment of the invention shown in FIGS. 7–9, in order to further control the movement of the slide block 34 from the retracted to the extended position, and to reduce noise associated with the movement of the slide block 34, the invention provides a damping device. In the embodiment illustrated in FIGS. 7–9, the device comprises a tubular-shaped elastomeric spring 112. However, it will be appreciated that other shapes or damping devices (for example, a coil spring) may likewise be utilized. However, a fabric coating rubber spring such as the Marsh Mellow™ spring manufactured by the Firestone Tire & Rubber Co. is currently preferred. The tubular-shaped spring 112 is disposed between a movable disk pin 114 along its lower surface and a stop plate 116 along its upper surface. The disk pin 114 is disposed within a bore 118, which opens into the elongated channel 84. In this way, as the slide block 34 moves from the retracted position (shown in FIG. 8) to the extended position (shown in FIG. 10), the stop pin 82 moves upward relative to the elongated channel 84 to rest and push against the disk pin 114 to compress the spring 112. In this way, the movement of the slide block 34 from the retracted position to the extended position is substantially dampened and noise associated with the movement is minimized as the spring 112 is compressed.

As best seen in FIGS. 8 and 9, the end of the stop pin 82 may be flattened along its upper surface to ensure a slip-free engagement of the disk pin 114 with the stop pin 82. Preferably, the end 120 of the stop pin 82 is formed as a rectangle, and the elongated channel 84 is formed with a corresponding elongated rectangular portion in which the end 120 of the stop pin 82 rides. It will be appreciated that the damping characteristics of the slide block 34 may be adjusted slightly by removing material from the upper surface of the end 120 of the stop pin 82.

As shown in FIGS. 7 and 8, the stop plate 116 that abuts the upper surface of the spring 112 is disposed in the upper surface of the slide block 34 and secured by bolts 124. Thus, it will be appreciated that the spring 112 may be easily replaced by simply removing the bolts 124 and stop plate 116. Removal of this stop plate 116 likewise provides easy access to the disk pin 114 for replacement or adjustment. In this way, the total damping distance travelled by the slide block 34, as well as the damping characteristics of the spring 112 as the slide block 34 moves from the retracted to the extended position may be easily modified and tailored to particular requirements within the limits of the range of travel. Similarly, the total travel of the slide block 34 may be increased by removing material from the slide block 34 to extend the length of the slot 84.

Similarly, in order to control the movement of the slide block 34 from the extended to the retracted position and to prevent damage to the die due to transient bounce, a second damping means is provided. It will be appreciated that sufficient damping force is required to prevent any transient bounce of the slide block 34 when it first contacts the driver assembly 32. In the first embodiment, two parallel nitrogen-filled cylinders 128 are provided. The nitrogen cylinders 128 shown are of a conventional design having a nitrogen-filled chamber defined by the inner wall of the cylinder and a piston (not shown). The nitrogen cylinders 128 may be charged through nitrogen hoses 130 to attain a desired damping coefficient. (It will be appreciated by those skilled in the art that the nitrogen cylinders should be discharged before disassembling the aerial cam unit 30.) Piston rods 132 coupled to the respective pistons extend downward from each nitrogen cylinder and abut upwardly extending stops 134. Preferably, the stops 134 are adjustable and replaceable. Consequently, the stops 134 may be adjusted to account for wear or to slightly modify the retracted position of the slide block 34.

Figure 14:
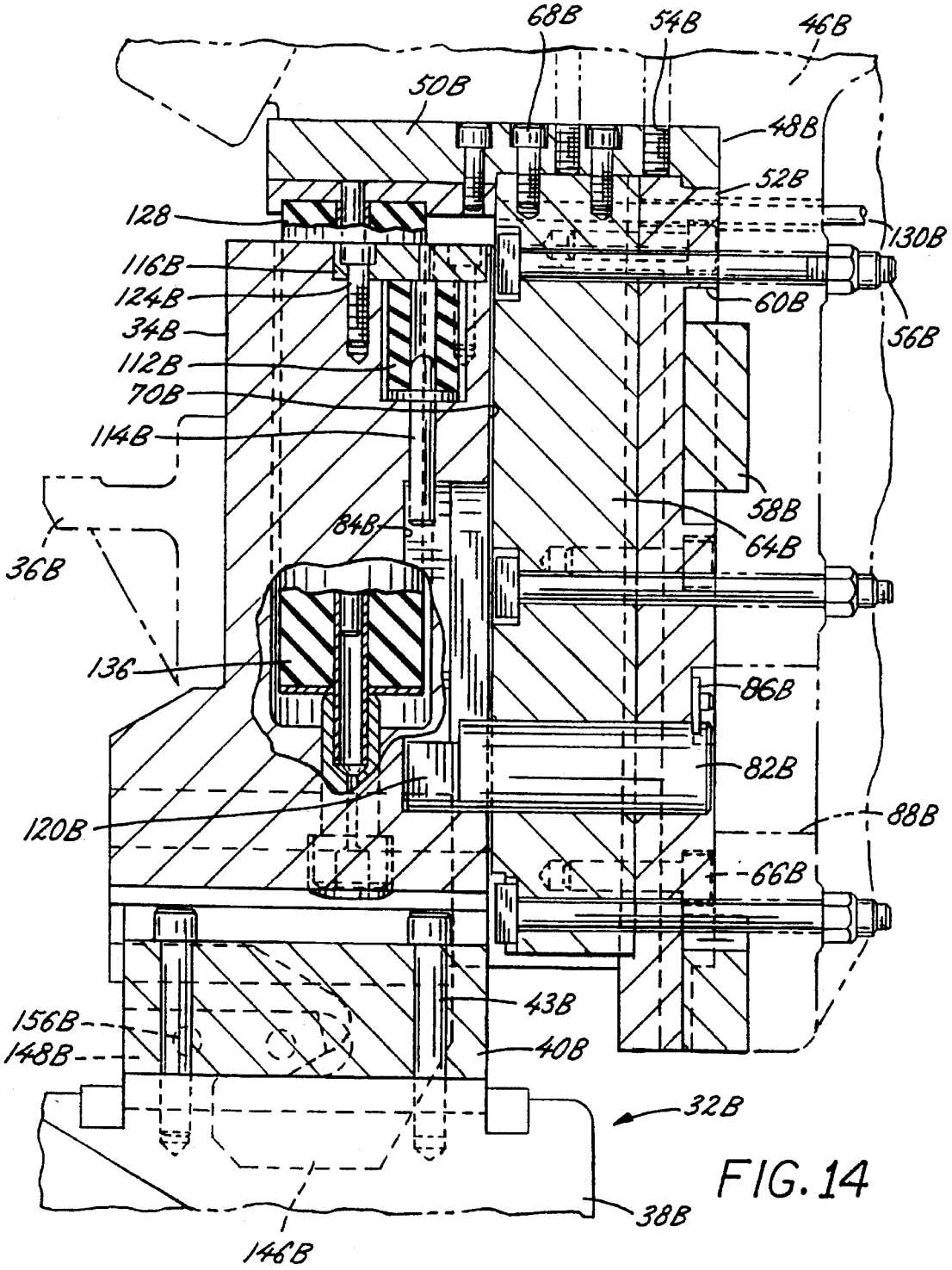

It will, however, be appreciated that one or more alternate damping devices could be utilized. As shown in FIG. 14, springs 136, similar to the spring 112 that controls movement of the slide block 34 from the retracted to the extended position, or the like may alternately be utilized. (The components of the device shown in FIG. 14 have been designated with the same numbers as those utilized in the first illustrated embodiment shown in FIGS. 7–10 followed by the letter "B".) For example, one or more coil springs or alternately shaped elastomeric springs could be incorporated (not illustrated).

Returning now to the embodiment shown in FIGS. 7–10, it will be seen that the extreme upward position of the slide block 34 is limited by a stop block 140, which is coupled to the top plate 50 by screws 142. Thus, it will be appreciated that the stop block 140 protects the nitrogen cylinders 128 as well as the hoses 130 from damage.

While the slide block 34 will ordinarily move from the retracted to the extended position due to the force of gravity and the force exerted by the compressed nitrogen in the nitrogen cylinders 128 or alternate damping device as the ram unit 25 moves upward, heavy damage could result to the tool 36 and aerial cam unit 30, as well as the lower die 26 and die post 27, and pressure pad unit 24, and other associated components of the press 20 should the slide block 34 become jammed in the retracted position. Consequently, to ensure that the slide block 34 returns to the extended position as the ram unit 25 moves upward, the invention provides a safety return mechanism. Safety return hooks 146 are provided along the sides of the slide block 34, extending downward from the block toward the driver assembly 32. As best seen in FIGS. 3–6, the safety return hooks 146 engage stripper guide blocks 148 disposed at the angle θ along the sides of the driver block 40 as the ram unit 25 moves downward within the press 20 and the inclined lower surface 44 of the slide block 34 slides downward across the upper inclined surface 42 of the driver assembly 32. If for some reason the slide block 34 does not return to its extended position on the upward stroke of the ram unit 25, thereby disengaging the tool 36 from the workpiece, the stripper guide blocks 148 will exert a relative downward force on the hooks 146 to move the slide block 34 from the retracted to the extended position and disengage the tool 36 from the workpiece. Those skilled in the art will thus appreciate that the positive safety return mechanism will prevent unnecessary damage to the tool 36 as well as the other components of the aerial cam unit 30 and the power press 20.

The hooks 146 are located on the slide block 34 by keys 150 disposed in keyways 152. As with other components of the aerial cam unit 30, the hooks 146 and stripper guide blocks 148 are likewise secured to the slide block 34 and driver block 40 by bolts 154, 156, respectively. Consequently, these components may likewise be easily replaced or adjusted to account for wear or to modify the design.

As most easily seen in FIGS. 7–9, the bolts that secure the components of the aerial cam unit 30 together are counter sunk to provide a smooth surface above each bolt. It will thus be appreciated that the bolts do not interfere with assembly or mounting of the unit 30, and cannot work loose during operation.

Figure 11:
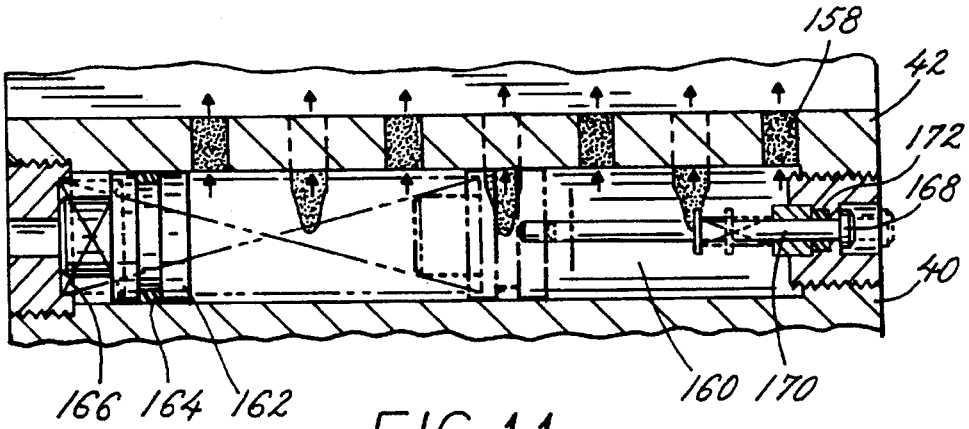

As an additional feature of the invention, the wear surfaces between the inclined upper surface 42 of the driver assembly 32 and the inclined lower surface 44 of the slide block 34 are provided with a lubricant. In the first illustrated embodiment, solid lubricant plugs 158 are provided along the upper inclined surface 42 of the driver (shown in FIGS. 7 and 11). As with the plugs 72 between the mating surfaces of the slide block 34 and the T-gib 64 and back plate 52, the plugs 158 may be composed of a solid lubricant graphite or another appropriate material. As shown in FIG. 11, the plugs 158 may be provided with a liquid lubricant, such as oil, from an internal well 160.

So that an operator may easily determine whether the well 160 contains sufficient oil to provide a well lubricated surface, the invention provides means for monitoring the level of lubricant contained in the well 160. A piston 162 is disposed within the well 160 and sealed by an O-ring 164. A spring 166 (represented by a solid "X" in FIG. 11) biases the piston 162 toward the lubricant contained in the well 160. Further included in the monitoring device is an indicator button 168 and rod 170, which is sealed by an O-ring 172. As the level of lubricant contained in the well 160 decreases, the spring 166 moves the piston 162 within the well 160 to approach the position indicated by the phantom lines. When the oil reaches a sufficiently low level, the piston 162 exerts a force on the rod 170 to move the rod 170 and button 168 to the position represented by the dotted lines, extending beyond the outer surface of the driver block 40. Thus, when the operator observes the button 168 extending beyond the outer surface of the driver block 40, lubricant may be added to the well 160 to restore it to a desired level and the button 168 and rod 170 may be pressed inward to restore the indicator to a reset position.

Figure 15:
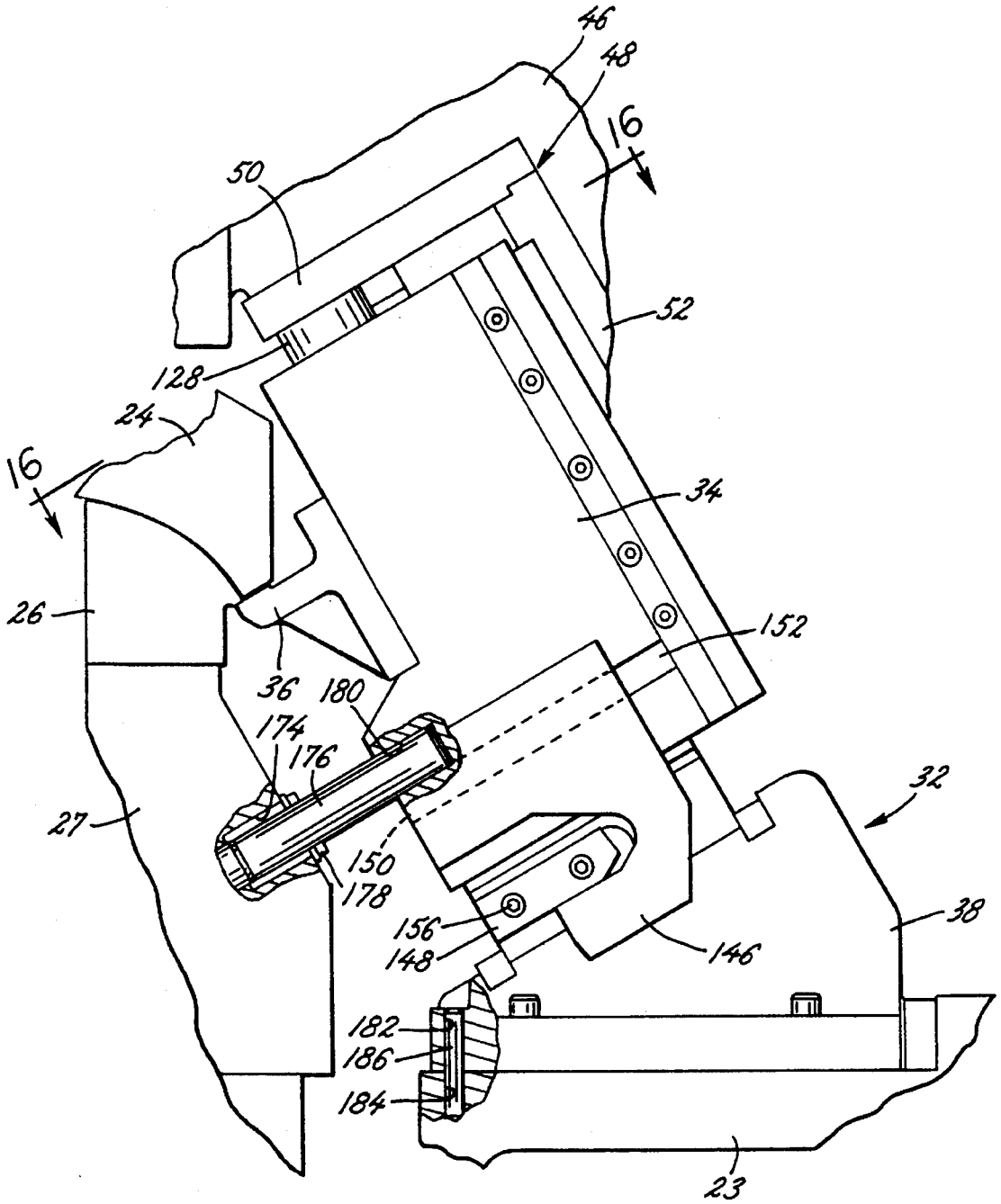
Figure 16:
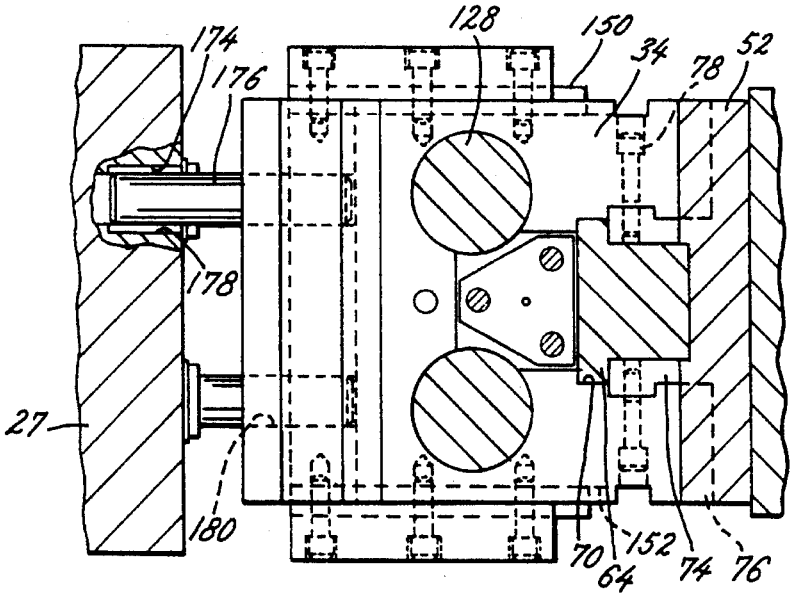

According to another feature of the invention, the aerial cam unit 30 may be used to facilitate proper alignment of the tool steel 36 for trimming, forming, piercing, and flanging operations. The recommended die setting procedure will be explained with reference to FIGS. 15 and 16.

In order to provide proper alignment of the slide block 34 with the lower die post 27, bushing openings 174 are provided at the correct angle from the travel of the ram 25 in the side surface of the lower die post 27. With the slide block 34 removed from the back plate 48, slide guide pins 176 are inserted into the bushing openings 174. To prevent damage to the lower die post 27 and to prevent the pins 176 from wedging in the bushing openings 174, the bushing openings 174 may be provided with bushings 178 that are located in the post 27 prior to insertion of the pins 176. Corresponding openings 180 in the slide block 34 are then located over and press fitted to the opposite ends of the pins 176. In the illustrated embodiment of the invention, two such bushing openings 174 in the post 27, two corresponding openings 180 in the slide block 34, and two pins 176 are provided so that the slide block 34 will be steady, and proper alignment may be achieved. Once the slide block 34 has been properly located, appropriate shim stock may be used to locate the tool 36 such that a desired clearance may be obtained between the tool 36 and the die post 27 to provide accurate operation of the tool 36. A recommended die clearance is on the order of 5% to 10% of the thickness of the material.

With the slide block 34 in position, the driver assembly 32 may be located and secured in its proper position and rigidly attached to the die shoe 23. In order to facilitate proper location of the driver assembly 32 and to steady the driver assembly 32 until it may be bolted down to the lower die shoe 23, one or more openings 182, 184 are provided in the driver assembly 32 and the lower die shoe 23, respectively, into which one or more dowels 186 and one or more threaded fasteners may be inserted. It will thus be appreciated that the aerial cam unit 30 may be easily mounted to provide accurate operation of the tool 36 to provide a desired operation on the workpiece.

Figure 17:
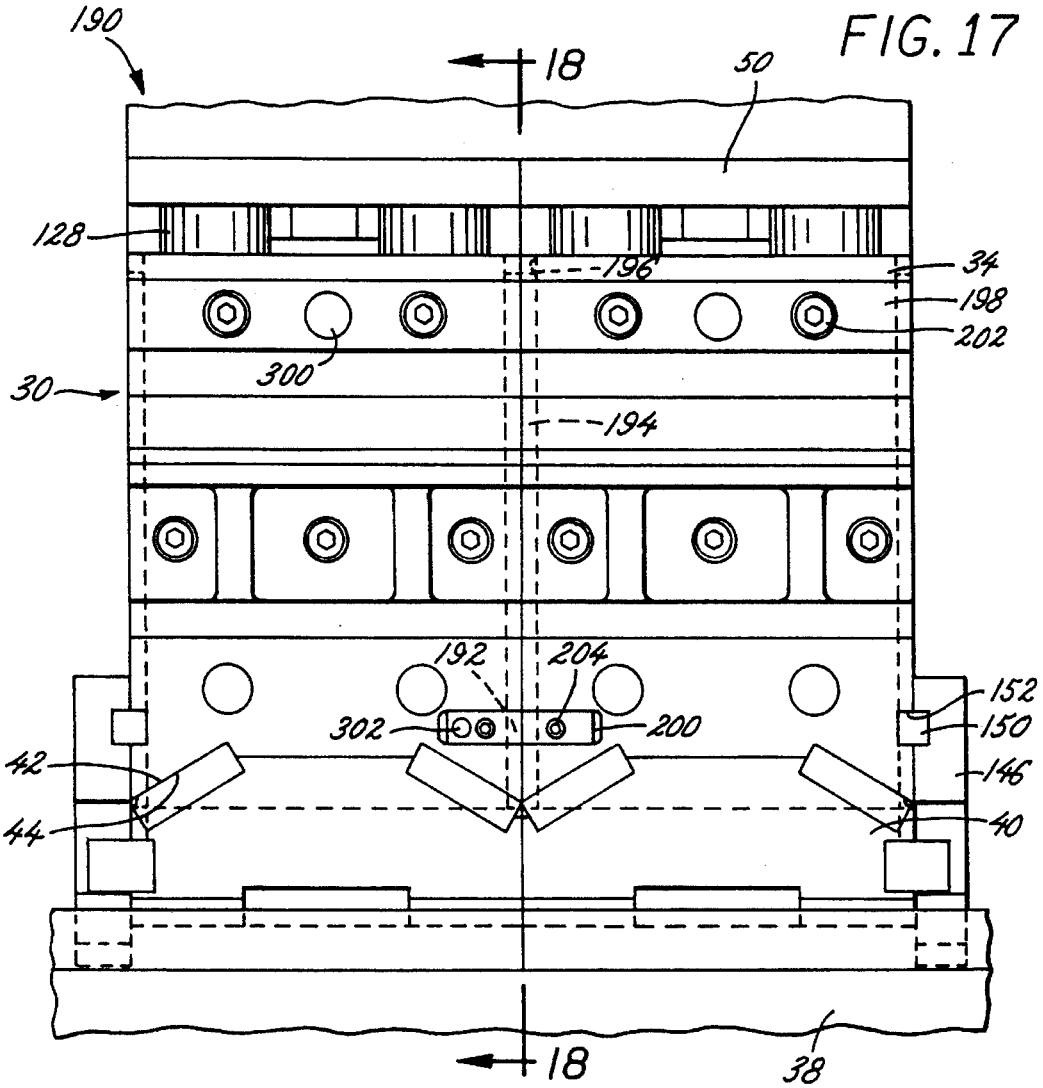
FIG. 17 is a view of a dual mounting of the aerial cam unit.
Figure 18:
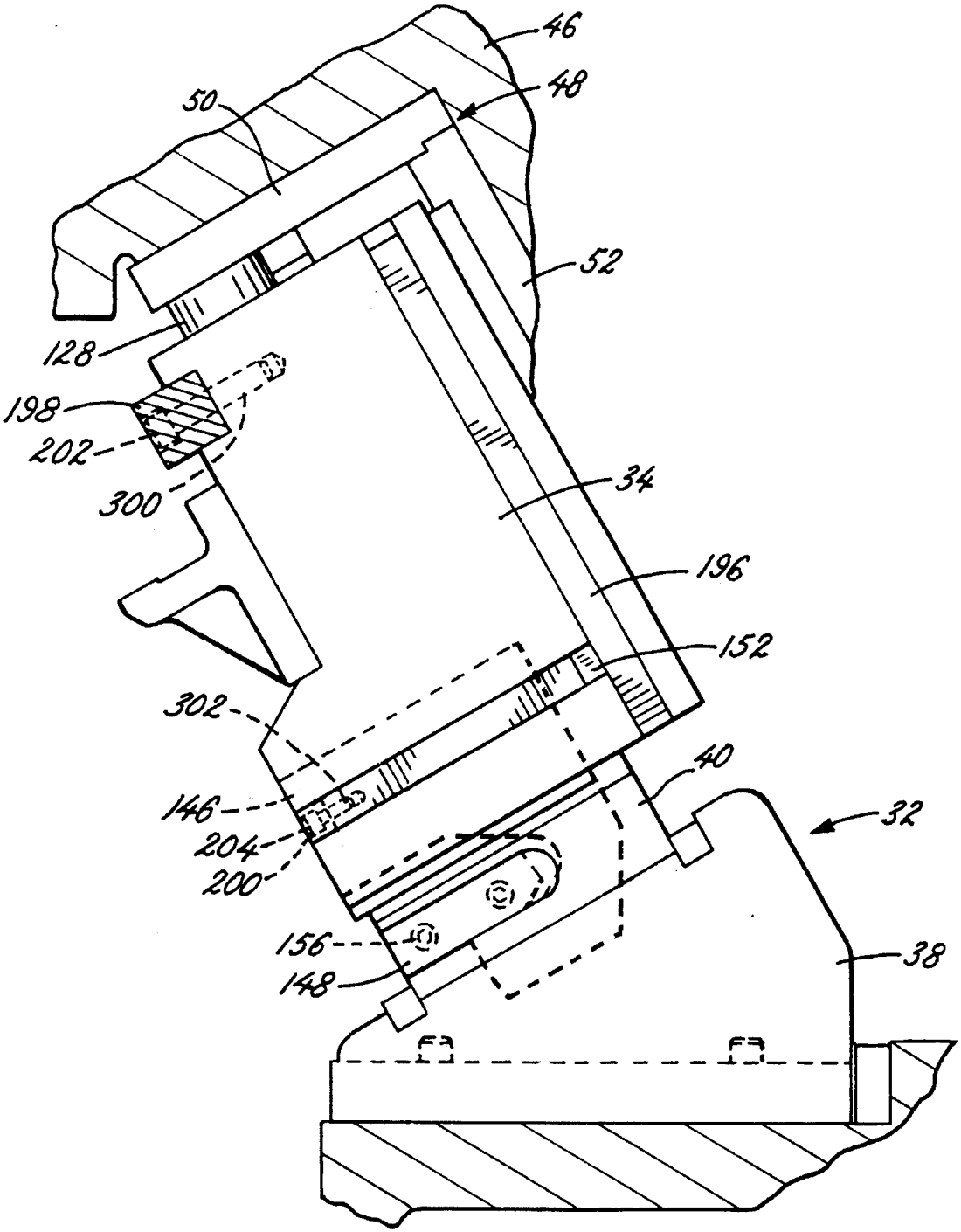
FIG. 18 is a cross-sectional view of the aerial cam unit taken along line 18—18 in FIG. 17.

According to yet another feature of the invention, aerial cam units 30 may additionally be used in groups of two or more for use in applications that require longer trim or form lines. One such grouping is shown in FIGS. 17 and 18 wherein two units 30 are grouped together as a dual unit 190. In order to provide a continual tool edge for performing the trim or form operation, the slide blocks 34 of the individual aerial cam units 30 may be positioned adjacent each other by removing the stripper hooks 146 from adjacently disposed sides of the slide blocks 34. The individual aerial cam units 30 may be precisely aligned together by positioning cross keys 192,194 in the keyway 152 and the keyway 196, respectively, along adjacent sides of the slide blocks 34. The units 30 may be further secured together by attaching keys 198, 200, which are secured to the units 30 by screws 202, 204, and dowels 300, 302, respectively. In this way, the individual units 30 may be coupled together to move simultaneously to provide longer trim or form operations on the workpiece.

In order to disassemble the unit 30, the nitrogen cylinders 128 are first discharged through the nitrogen hoses 130. Then, to release the slide block 34, the ram unit 25 is lowered until the slide block 34 moves to its retracted position, sliding along the driver assembly 32. The retaining plate 86 is then removed through the access opening 88, freeing the stop pin 82, which may likewise be removed through the access opening 88. With the stop pin 82 removed, the ram 25 may be moved upward so that the slide block 34 slides off of the T-gib 64. The back plate 48 may then be easily removed from the mounting bracket 46 by removing bolts 54, 56. The driver assembly 32 may likewise be easily removed by removing the bolts 45, which secure it to the press bed 22.

Figure 20:
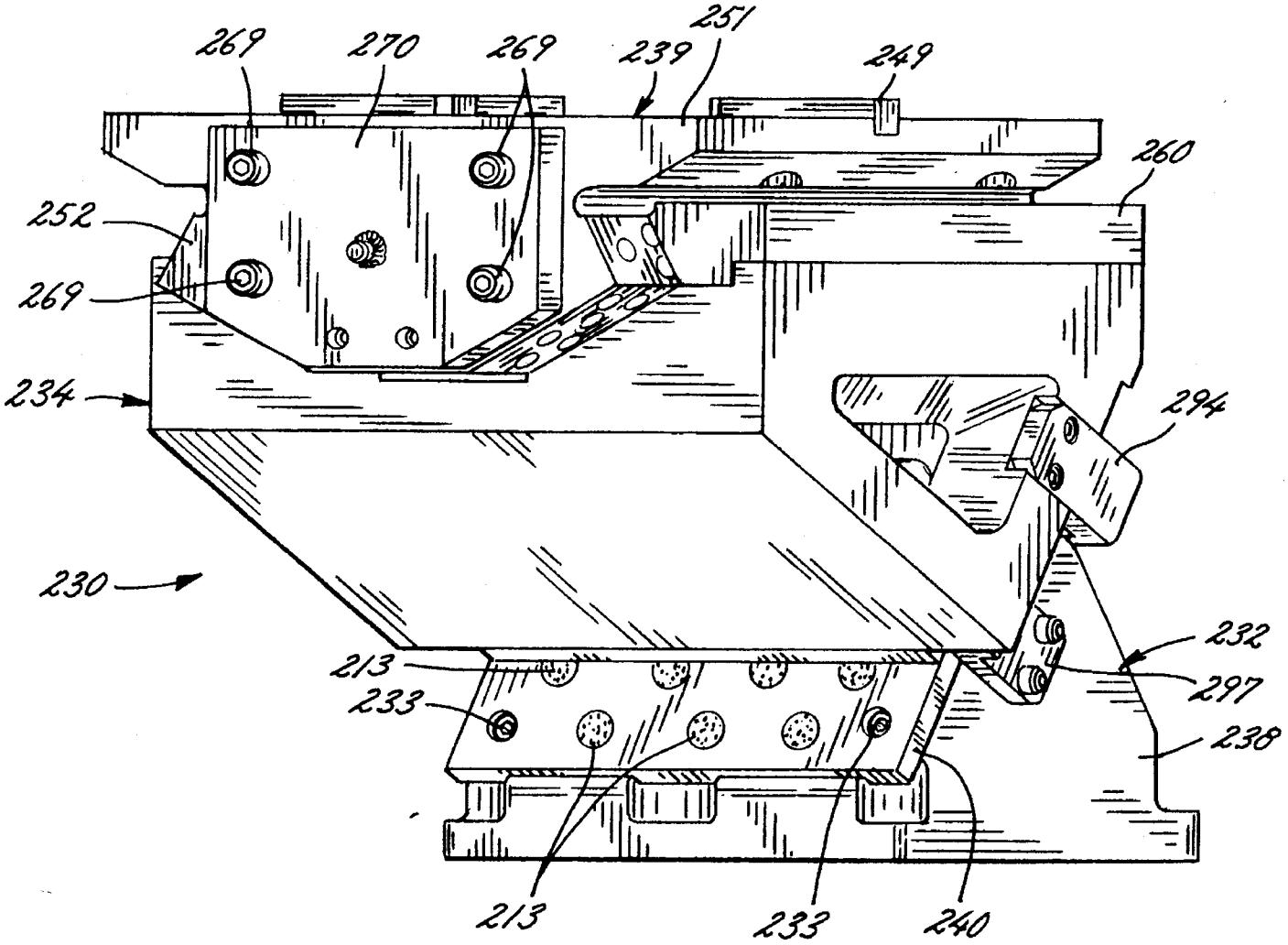
FIG. 20 is a right, front perspective view of the second embodiment of the universal cam unit mounted without a mounting wedge.

A second embodiment 230 of the universal cam unit is shown generally in FIG. 20. This second embodiment 230 comprises a driver assembly 232, a slide block 234 to which a tool (not shown) is secured for performing a desired operation on the workpiece, and a mounting bracket 239, which couples the slide block 234 to the ram (not shown) for movement therewith. As in the first embodiment, the slide block 234 is slidably coupled to the mounting bracket 239 for movement between two extreme positions, namely, a retracted position and an extended position. The retracted position is defined as the position in which the slide block 234 is disposed furthest from the workpiece. The extended position is defined as the position in which the slide block 234 is disposed closest to the workpiece.

Figure 21:
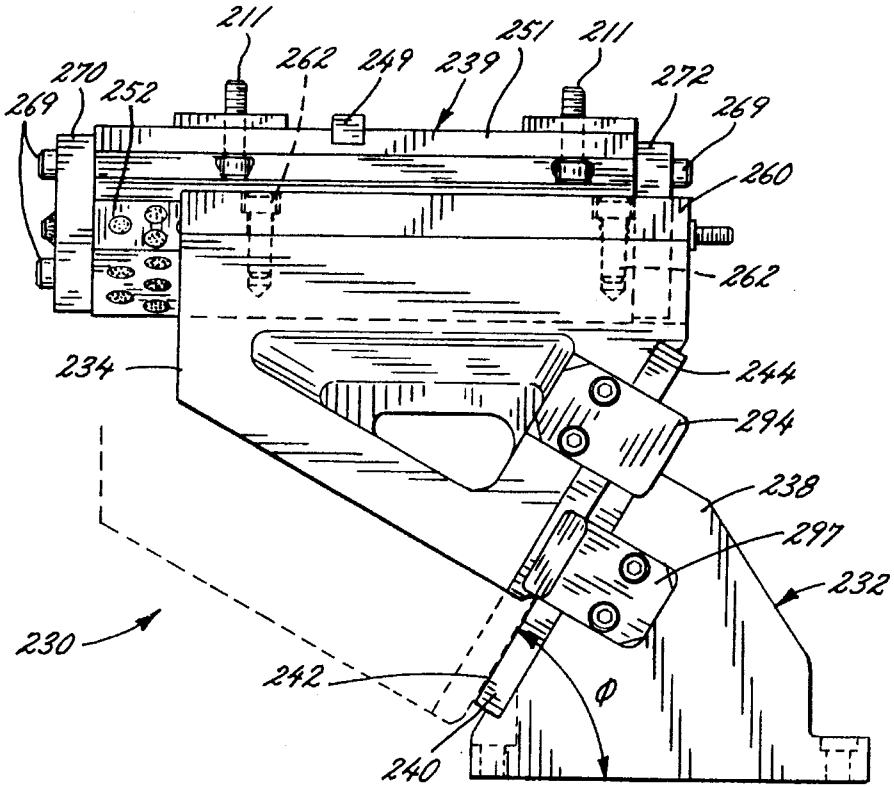
FIG. 21 is a right side view of the second embodiment.

As best seen in FIGS. 20 and 21, the driver assembly 232 preferably includes a driver base 238 and a driver block 240. The driver base 238 is mounted to the lower die shoe of the power press to prevent relative movement. The driver block 240, which is preferably secured to the driver base 238 by bolts 233, has an upper bearing surface 242 inclined at an angle θ. The use of bolts 233 insures that the driver block 240 can be easily removed for replacement and/or repair when the upper bearing surface 242 begins to show signs of wear. This removability minimizes expenses since only a portion of the driver assembly 232 will periodically require replacement from use. The overall life of the driver assembly 232 should thus be extended. However, it will be appreciated by those skilled in the art that, the driver block 240 and base 238 can be integrally formed without departing from the invention.

Figure 23:
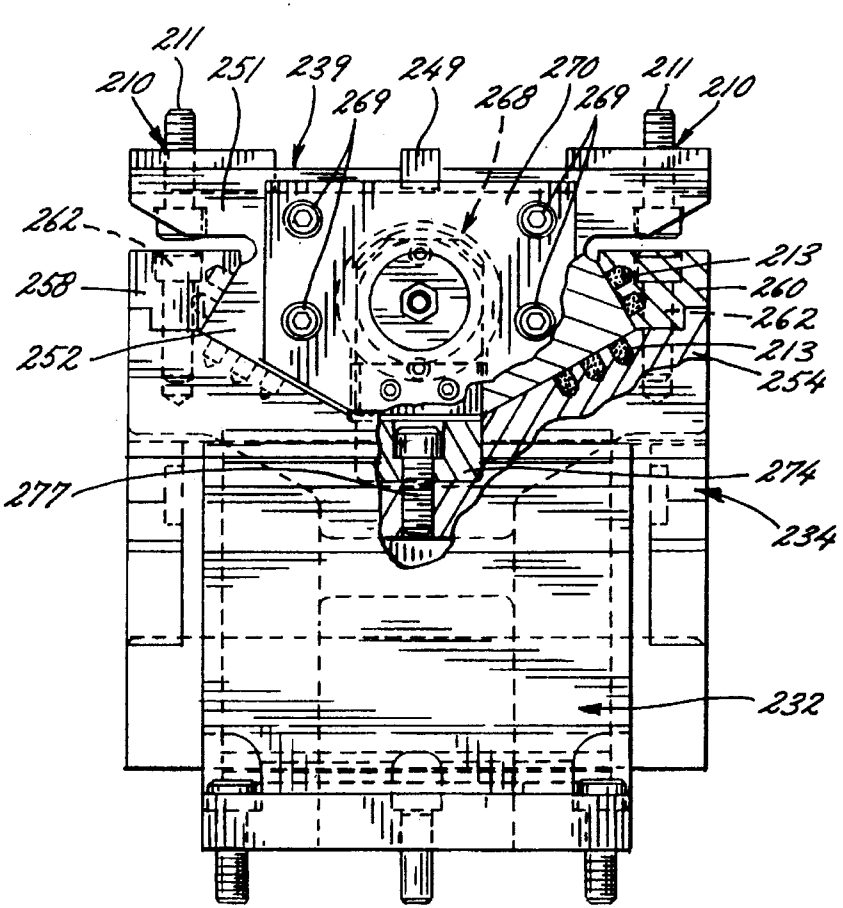
FIG. 23 is a partial sectional view of the second embodiment illustrating the engagement of the slide block and the gib.

As illustrated in FIG. 23, the mounting bracket 239 includes a gib 252 and a mounting structure or panel 251, which are preferably integrally formed. The mounting structure 251 is the flat upper, plate-type portion of the mounting bracket 239, which includes bores 210 through which bolts 211 extend to secure the mounting structure 251 to the ram. The mounting bracket 239 is preferably positioned on the ram by keys 249 and then bolted directly to the ram.

Figure 19:
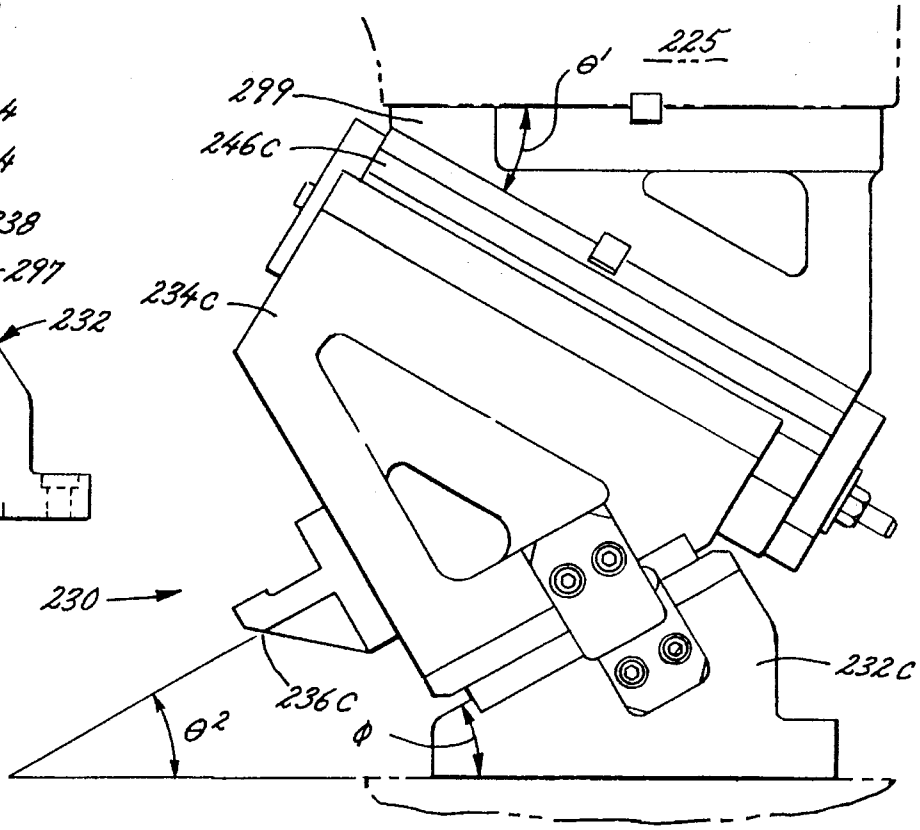
FIG. 19 is a right side view of a second embodiment of the universal cam assembly illustrating the cam assembly with an inserted mounting wedge.

Alternately, mounting wedges 299 can be used with the unit 230 to achieve a wide variety of ram travels and angles of approach as illustrated in FIG. 19. The angle θ can thus be changed by replacing the driver assembly 232 with a driver assembly 232C having a different angle θ and inserting a mounting wedge 299 between the mounting bracket 246C and the ram 225C. (The components of the device shown in FIG. 19 have been designated with the same numbers as those utilized in the second illustrated embodiment followed by the letter "C".) The angle θ, and consequently, the angle of approach of the tool 236C relative to the die and the die post as the slide block 234C moves relative to the ram 225C, can thereby be changed to any angle between 0° and 75° that the designer desires. Thus, the use of the mounting wedge 299 and the modified driver assembly 232C, obviates the need for designer variation or replacement of the slide block 234C to achieve proper tool orientation during operation. As a result, the present invention provides a standardized slide block 234C that can be used to perform tooling operations at a wide range of angles without requiring replacement of the entire cam unit.

It will further be appreciated by those skilled in the art that the use of a mounting wedge 299 enables the user to minimize the ram travel during operation. The length of the ram travel (L) depends on the angle of inclination of the wedge 299 ($\Theta^1$) the angle of the tool 236C relative to the horizontal ($\Theta^2$) and the length of the working stroke (S) according to the following formula:

$$L = S \cdot \frac{\sin(\Theta^1 + \Theta^2)}{\cos \Theta^1}$$

Thus, by choosing wedges of appropriate angles, the user can select an angle of wedge inclination $\Theta^1$ and an angle of tool inclination $\Theta^2$ to achieve a desirable ram travel that is sufficient to allow easy manipulation of the workpiece without unduly slowing production by being excessive.

It will be appreciated by those skilled in the art that although the mounting wedges 299 have been illustrated in connection with the second embodiment 230 of the universal cam unit, the wedges 299 can be similarly employed with the above-described first embodiment 30 as well as with the additional embodiments described below without departing from the invention. Thus, although in the interest of brevity the mounting wedges 299 will only be specifically illustrated in connection with the second embodiment 230, there is no intent to limit or restrict the use of the mounting wedges to use with a particular embodiment of the invention.

Returning to FIG. 23, it can be seen that the gib 252 has a "dove tail" shape and is disposed at the lower portion of the mounting bracket 239. As clearly illustrated in FIGS. 21 and 23, the gib 252 and the mounting structure 251 lie in parallel planes. The gib 252 defines the linear path of the slide block 234, which likewise lies in a plane parallel to the gib and mounting structure planes.

In the aerially mounted configuration, the slide block 234 is coupled to the ram unit of the power press for vertical movement therewith by a mounting bracket 239. The slide block 234 includes a slide block bracket 254 which preferably has an upwardly opening U-shaped cross-section. Thus, throughout the specification bracket 254 will be referred to as U-shaped bracket 254. This upwardly opening U-shaped bracket 254 is slidably disposed adjacent the dove tail gib 252, as shown in FIG. 23. The U-shaped bracket 254 can be either bolted to, or integrally formed with the slide block 234. However, in the preferred embodiment, the U-shaped bracket 254 and the slide block 234 are integrally formed. The U-shaped bracket 254 is coupled to the dove tail gib 252 by removable retaining stops 258, 260 which combine with the U-shaped bracket 254 to surround the gib 252 and thereby provide a slidable engagement. The retaining stops 258, 260 are coupled to the bracket 254 by bolts 262 and thus, are easily removed for replacement or repair.

As illustrated in FIG. 21, the slide block 234 includes an inclined lower surface 244, which is disposed parallel to the inclined upper surface 242 of the driver assembly 232. During operation, as the slide block 234 is lowered along with the ram, the inclined lower surface 244 of the slide block 234 contacts the inclined upper surface 242 of the driver assembly 232. The inclined lower surface 244 slides downward along the inclined upper surface 242 which results in a corresponding movement of the slide block 234 in a horizontal direction to bring the tool into contact with the workpiece.

It will be appreciated by those skilled in the art that the universal cam unit employs many slidably engaged surfaces which can show signs of wear after periods of use. Many of these wear-prone surfaces are supplied with lubricating plugs to minimize the stresses associated with wear. To this end, the second embodiment 230 of the universal cam unit preferably includes lubricating plugs 213 in the inclined bearing surface 242 of the driver assembly 232 (as best seen in FIG. 20) and in the U-shaped bracket 254 of the slide block 234 (as best seen in FIG. 23). It will be appreciated by those skilled in the art that lubrication plugs positioned in other areas of the unit 230 and other lubricating devices such as those discussed in connection with the first embodiment could also be employed with any of the embodiments discussed without departing from the invention.

Figure 22:
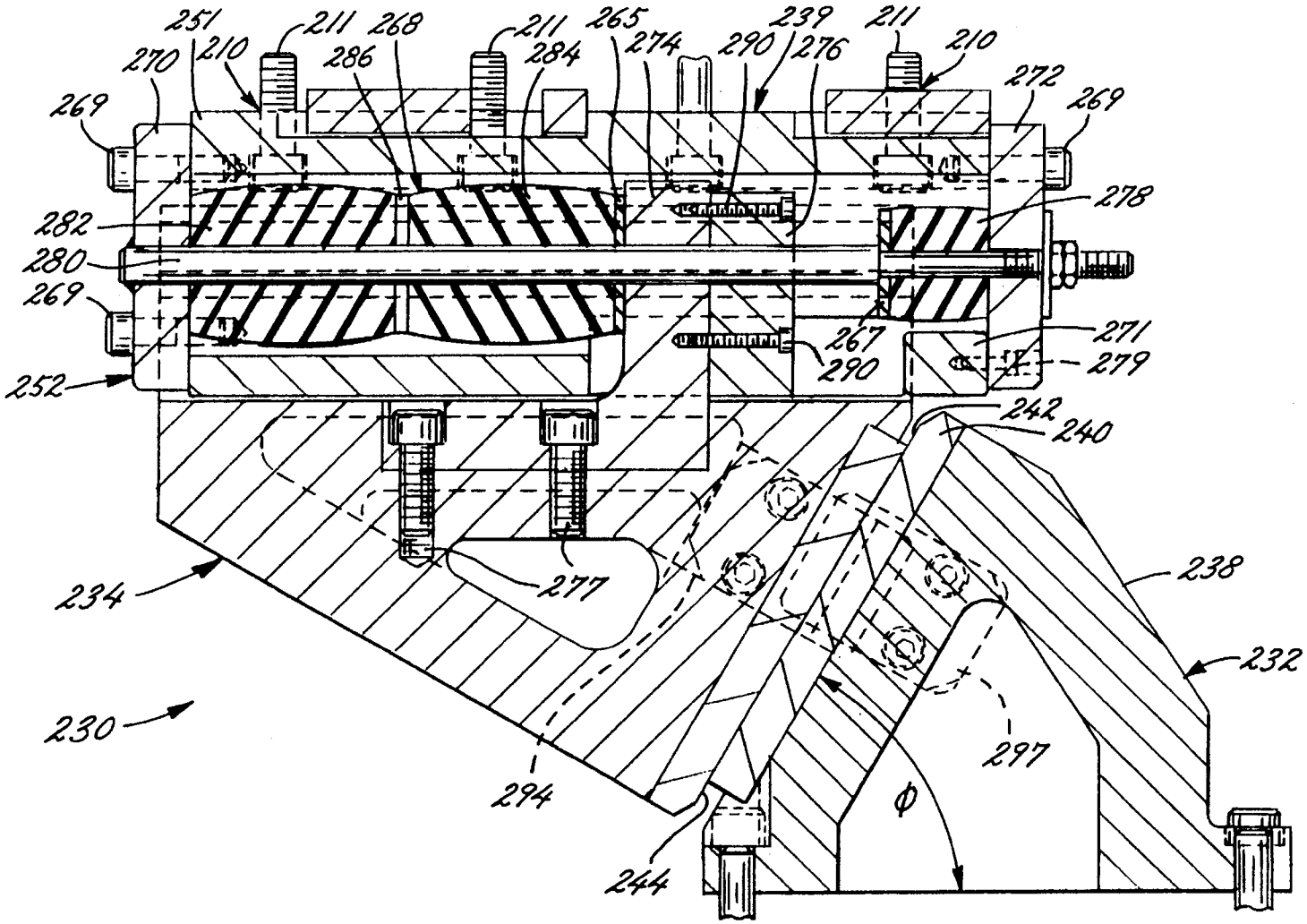
FIG. 22 is a sectional view of the second embodiment illustrating the construction of the damping assembly.

The second embodiment 230 of the universal cam unit is provided with a spring assembly 268 for returning the slide block 234 to its home position after it travels along the mounting bracket 239 and driver assembly 232. As illustrated in FIG. 22, the spring assembly 268 preferably comprises two retaining stop blocks 270, 272 coupled to the mounting bracket 239, a compression arm 274 and attached spacer 276 coupled to the slide block 234, a centering rod 280, two return springs 282, 284 and a damping spring 278. In the preferred embodiment, the retaining blocks 270, 272 are coupled to the mounting bracket 239 and the compression arm/spacer combination 274/276 is coupled to the slide block 234 via bolts 269, 277, respectively. Further, the spacer 276 is preferably coupled to the compression arm by bolts 290. The use of bolts makes each of these components easily removable for repair or replacement which insures that damage or wear to one component of the cam unit will not necessitate replacement of the entire unit 230. The replaceability of these parts, thus, increases the overall work life of the cam unit as a whole.

Figure 33:
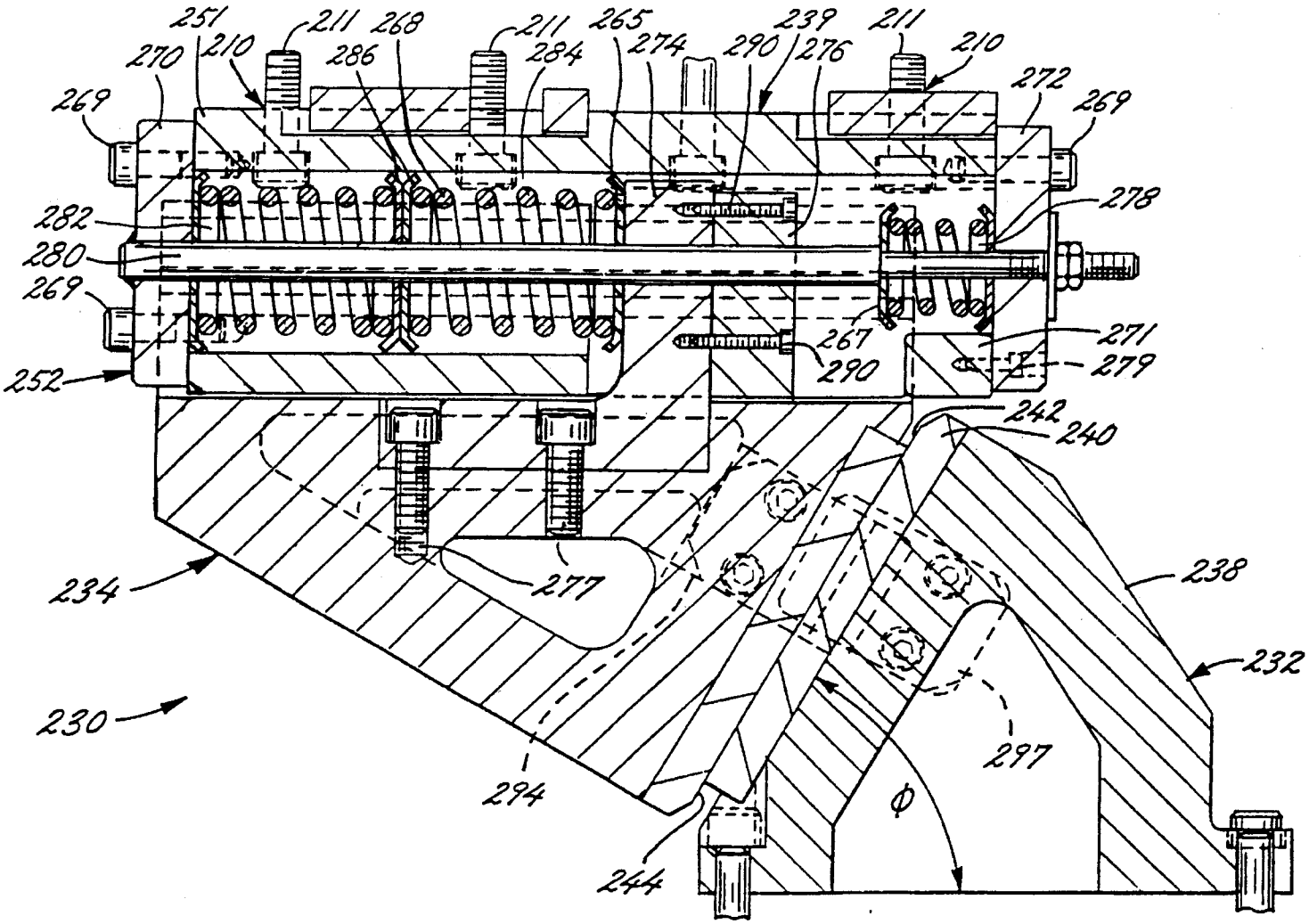
FIG. 33 is a view similar to FIG. 22 but illustrating an alternative embodiment employing coil springs as the damping and return springs.

It will be appreciated by those skilled in the art that the return springs 282, 284 could be replaced by a single spring without departing from the invention. However, in the preferred embodiment two return springs 282, 284 disposed in series and separated by a washer 286 are employed. The return springs 282,284 and the damping spring 278 are all disposed within the gib 252. Preferably, all of the springs 278, 282, 284 are Marsh Mellow™ springs. However, it will be appreciated by those skilled in the art that coil springs could also be used as return springs 282, 284 and/or damping spring 278 as shown in FIG. 33.

As best seen in FIG. 22, the centering rod 280 is coupled to the retaining stop blocks 270, 272 and extends through each of the following components to maintain the spring assembly 268 in alignment: the return springs 282, 284 and separating washer 286, the compression arm/spacer combination 274, 276, and the damping spring 278. The compression arm/spacer combination 274, 276 is slidably disposed along the centering rod 280 between the return springs 282, 284, and the dampening spring 278 and operates as explained below.

During operation of the press, when the ram is lowered, the slide block 234 moves to the left in the view shown in FIGS. 21 and 22. The attached compression arm/spacer combination 274, 276 contacts and exerts a force against the return springs 282, 284 such that the springs exert a force opposing the movement of the slide block 234. The compression arm/spacer combination 274, 276 may continue to move to the left against the force of the return springs 282, 284, until the specified full travel is attained (i.e. the return springs 282,284 are fully compressed). When the compression arm 274 fully compresses the return springs 282, 284, the slide block 234 is in the extended position.

As the ram is raised, the slide block 234 and attached compression arm/spacer combination 274, 276 move to the right. Eventually, the spacer 276 contacts and starts to compress the damping spring 278. The compression arm/spacer combination 274, 276 may continue to compress the damping spring 278 until the spacer 276 contacts the stop block 271 which is affixed to retaining stop block 272 by a bolt 279. Thus, in addition to damping the movement of the slide block 234, the spring 278 prevents abrupt metal-to-metal contact, and, therefore, abates the noise associated with the operation of the universal cam unit.

The compression arm 274 and the spacer 276, along with the stop blocks 270, 271, 272, and the gib 252, define the travel of the slide block 234 and, therefore, the compression limits of the springs 278, 282 and 284. The ultimate travel limit of the slide block 234 on the downstroke (i.e., the extended position) is determined by the compression arm 274 and the maximum compression of springs 282, 284. The ultimate travel limit of the slide block 234 on the upstroke (i.e., the retracted position) is determined by the thickness of the spacer 276 and the stop block 271, and can therefore be set by varying the thickness of the spacer 276 and/or the stop 271.

It will be appreciated by those skilled in the art that the spring assembly 268 can be provided with washers 265, 267 as illustrated in FIG. 22. When used, these washers 265, 267 are positioned between the springs 284, 278 and the compression arm/spacer combination 274, 276 to protect the springs 284, 278 from the stress associated with the movement of the compression arm/spacer combination. Specifically, the washers 265, 267 prevent the compression arm/spacer combination 274, 276 from directly striking the springs 284, 278 and, thus, extend the spring's useful life. Because of these advantages, the washers 265, 267 are preferably included in the second embodiment.

While the slide block 234 will ordinarily move from the extended to the retracted position due to the force exerted by the springs 282, 284 as the ram unit moves upward, to ensure that the slide block 234 returns to the retracted position, the second embodiment 230 of the universal cam unit includes a safety return mechanism similar to the mechanism illustrated in connection with the first embodiment 30. As best seen in FIG. 21, the safety return mechanism comprises stripper guide hooks 294 mounted along the sides of the slide block 234 and stripper guide hooks 297 disposed along the sides of the driver assembly 232. The slide block hooks 294 extend downward toward the driver assembly 232, while the driver hooks 297 extend upward toward the slide block 234. As illustrated in FIGS. 20 and 22, the hooks 294 of the slide block 234 engage the hooks 297 of the driver assembly 232 as the press closes and the inclined lower surface 244 of the slide block 234 slides downward across the upper inclined surface 242 of the driver assembly 232. As the press opens, the stripper guide hooks 297 exert a relative downward force on the corresponding hooks 294 to move the slide block 234 and disengage the tool from the workpiece should the slide block 234 become jammed when the ram is in the closed position. It will be appreciated by those skilled in the art that the stripper guide hooks attached to the opposite side of the second embodiment (not shown) are mirror images to those illustrated in FIGS. 19–22. Thus, the hidden hooks operate in precisely the same manner as the illustrated hooks 294, 297.

Figure 24:
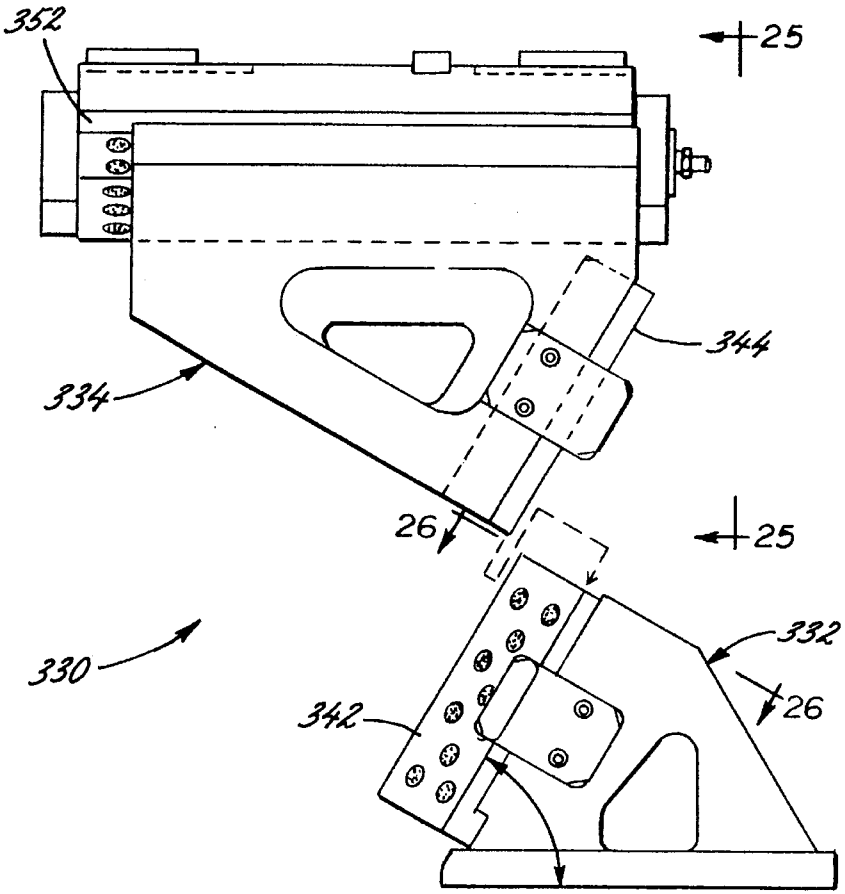
FIG. 24 is a right side view of a third embodiment of the universal cam unit with the slide block and driver assembly separated.
Figure 25:
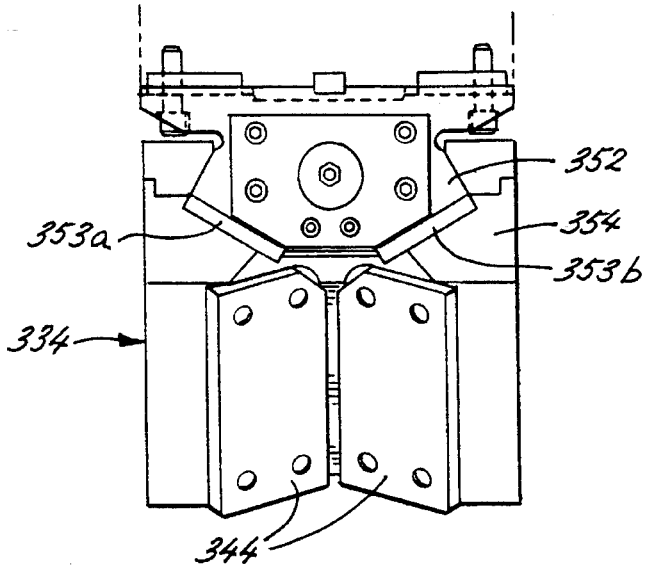
FIG. 25 is a back view of the slide block of the third embodiment of the cam unit taken along lines 25—25 of FIG. 24.
Figure 26:
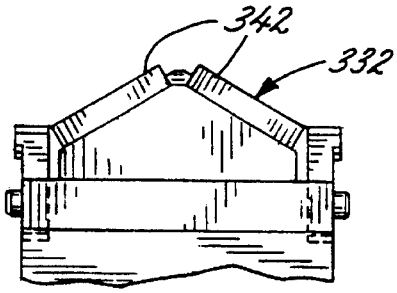
FIG. 26 is a plan view of the driver assembly of the third embodiment of the universal cam unit taken along lines 26—26 of FIG. 24.

A third embodiment 330 of the universal cam unit is illustrated in FIG. 24. This third embodiment 330 includes basically the same structure as the second embodiment 230 of the universal cam unit with the exception of two features. As illustrated in FIGS. 25 and 26, the parallel upper and lower bearing surfaces 342, 344 of the driver assembly 332 and the slide block 334, respectively, have an inverted V-shape, rather than the flat shape of the inclined surfaces employed by the second embodiment 230. Additionally, wear plates **353*a*, 353*b* are coupled to the U-shaped structure 354. These wear plates 353*a*, 353*b* are slidably disposed adjacent the gib 352. The third embodiment 330, like the first and second embodiments 30, 230, can also be utilized in conjunction with mounting wedges (not shown) to vary the angle of approach of the slide block 334** and tool (not shown).

Figure 27:
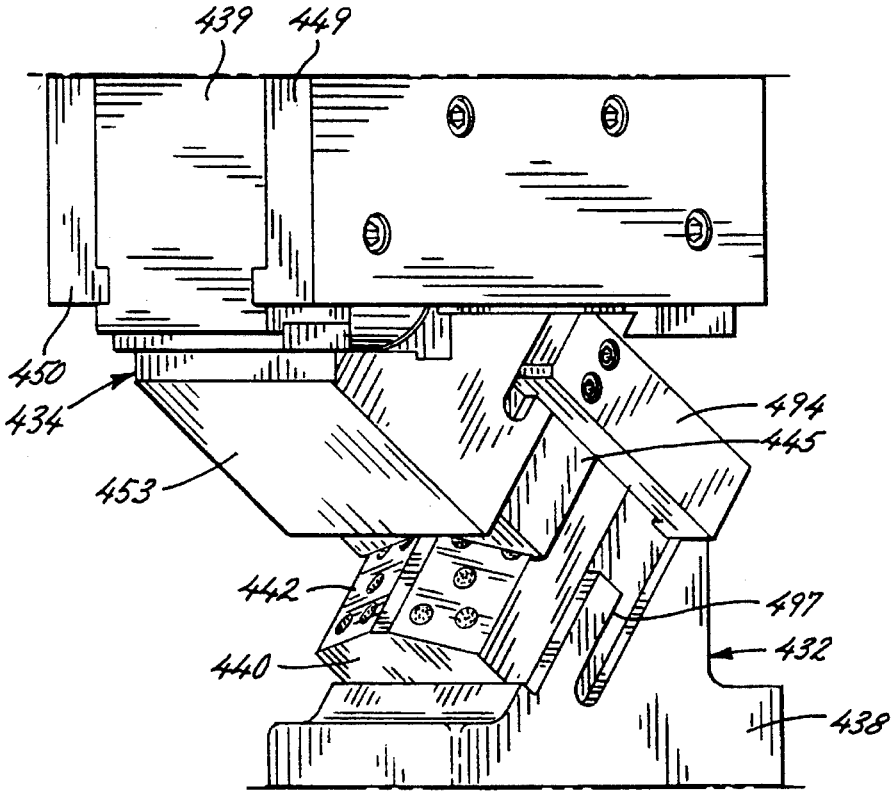
FIG. 27 is a right, front perspective view of a fourth embodiment of the universal cam unit.
Figure 28:
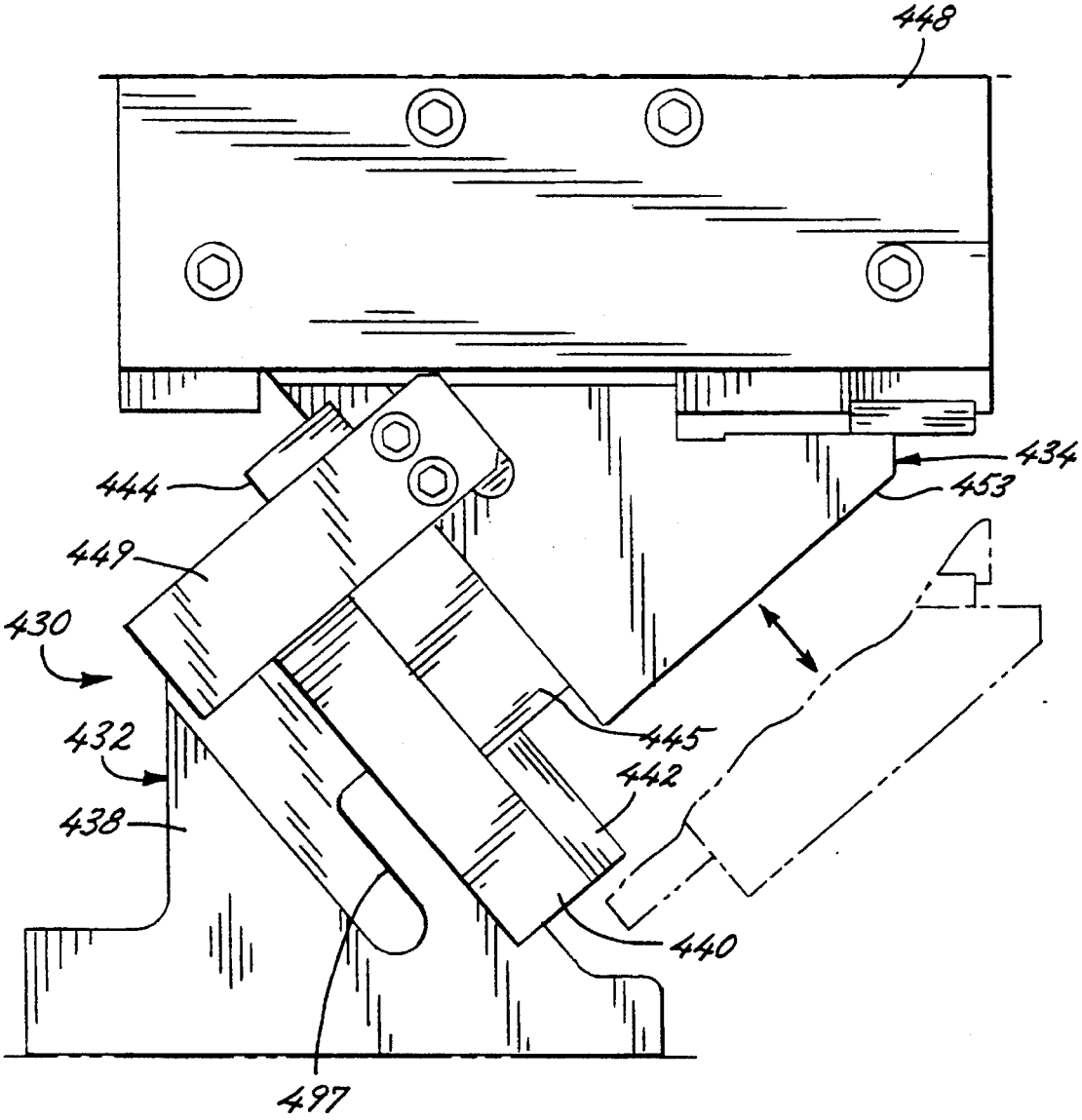
FIG. 28 is a right side view of the fourth embodiment.

A fourth embodiment 430 of the universal cam unit is illustrated in FIG. 27. This fourth embodiment 430 includes much of the same structure as the second embodiment 230 of the universal cam unit. In the interest of brevity, this description will not reiterate in detail the components of the fourth embodiment 430 that have the same basic structure as the second embodiment 230. It should be noted that, as with the second and third embodiments 230, 330, the fourth embodiment 430 may be utilized with mounting wedges in order to change the angle of approach of the slide block 434 and tool (not shown).

Figure 32:
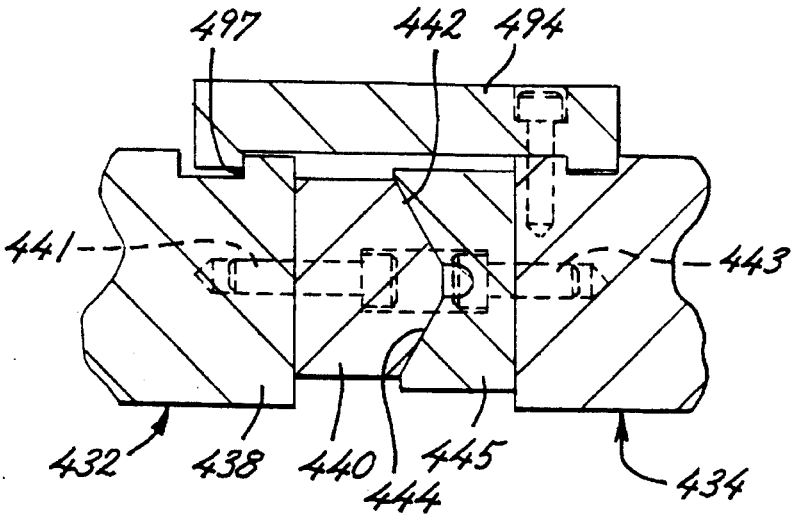
FIG. 32 is a partial cross-sectional view taken along lines 32—32 of FIG. 29.

As in the second embodiment 230, the driver assembly 432 of the fourth embodiment 430 includes an inclined upper surface 442 for engaging the inclined lower surface 444 of the slide block 434. However, as shown in FIG. 32, the driver assembly 432 of the fourth embodiment 430 includes a driver block 440, which is fixed to a driver base 438 by bolts 441, and an engagement block 445, which is fixed to a slide block 434 by bolts 443. The inclined upper surface 442 of the driver block 440 and the inclined lower surface 444 of the engagement block 445 are slidably disposed. These sliding surfaces 442, 444 have an inverted V-shape.

The fourth embodiment 430 of the universal cam unit employs a safety return mechanism similar to the mechanism employed by the second embodiment 230. However, while operation of the safety return hook 494 is similar to the second embodiment 230, the stripper guide hook 494 of the fourth embodiment 430 engages a ledge 497 which is integrally formed in the driver assembly 438 rather than a corresponding hook as illustrated in the earlier embodiments.

Figure 29:
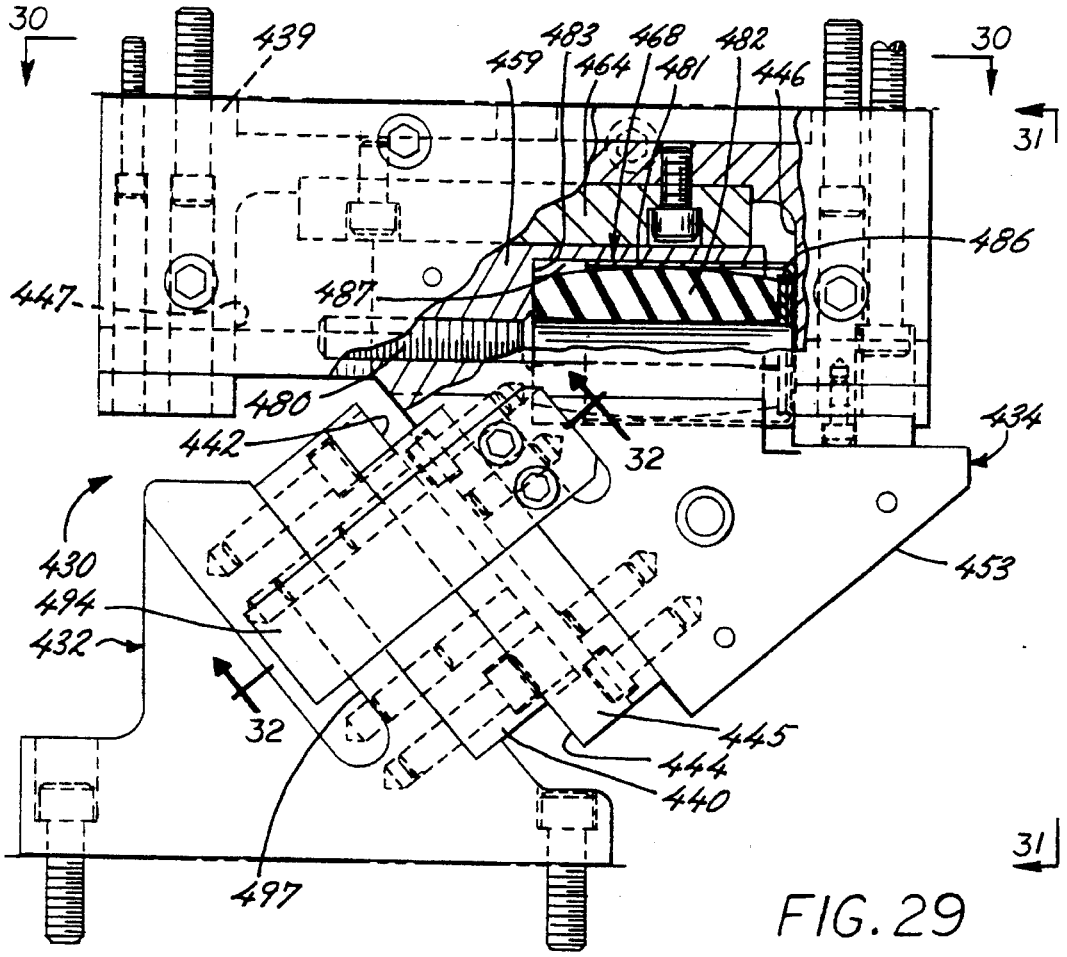
FIG. 29 is a partial sectional view of the fourth embodiment illustrating the damping assembly.
Figure 30:
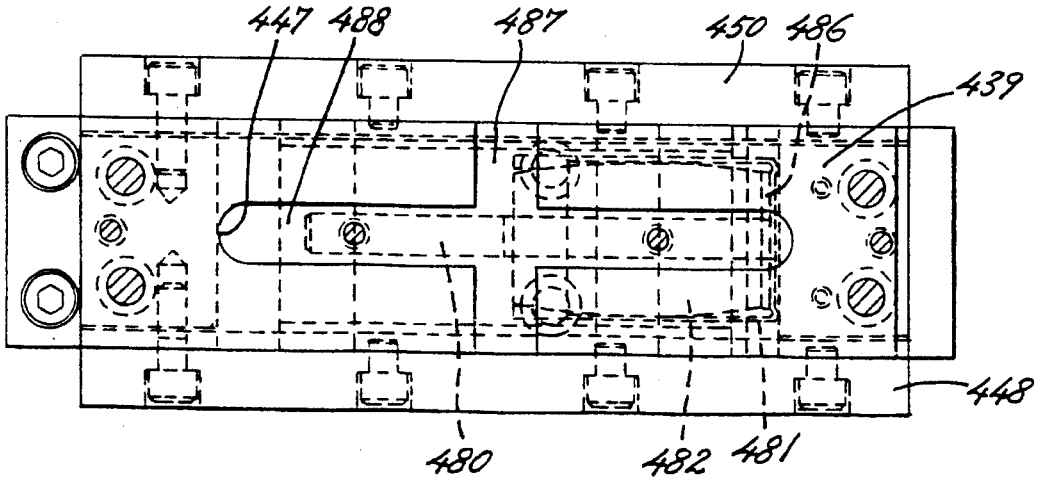
FIG. 30 is a partial sectional view of the fourth embodiment taken along lines 30—30 of FIG. 29.
Figure 31:
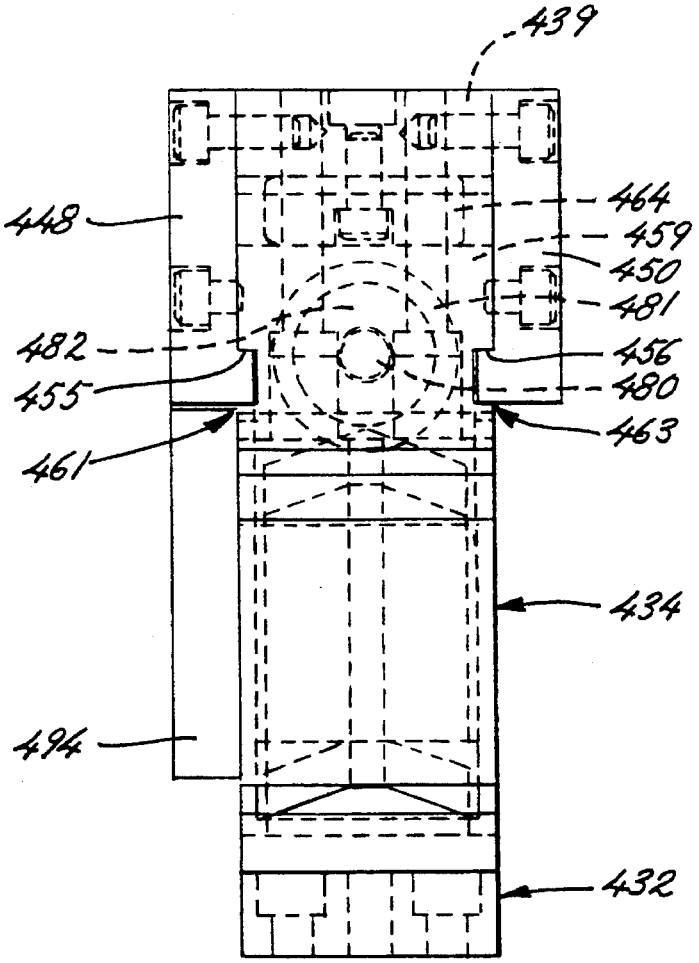
FIG. 31 is a sectional view of the fourth embodiment taken along lines 31—31 of FIG. 29 and illustrating the engagement of the slide block and the keyed rail guidance assembly.

As best seen in FIGS. 29 and 31, the slide block 434 is slidably coupled to the ram unit of the power press by a keyed rail guide assembly. The mounting bracket 439 of the fourth embodiment 430, which forms part of this keyed rail guide assembly, has an inverted C-shape as shown in FIG. 29. The C-shaped mounting bracket 439, thus, includes two open sides and two closed sides. Two keyed rails 448, 450 which form inwardly directed ledges 455, 456 are coupled to the open sides of the bracket 439 as shown in FIGS. 30 and 31.

As best seen in FIG. 31, the slide block 434 includes a support block 459. Preferably, this support block 459 has a rectangular shape and is integrally formed with the slide block 434. Further, the rectangular support block is preferably disposed immediately above keyports 461, 463 contained in the side block 434. These keyports 461, 463 slidably engage inwardly directed ledges 455, 456 of the keyed rails 448, 450 such that the rails surround and support the rectangular support block 459.

As best illustrated in FIG. 29, the fourth embodiment 430 of the universal cam unit is further provided with a wear plate 464 which is coupled to the mounting bracket 439 and slidably contacts the upper surface of the rectangular support block 459. This wear plate 464 combines with the keyed rails 448, 450 to define a channel for movement of the rectangular support block 459 and the attached slide block 434.

As illustrated in FIG. 29, the spring assembly 468 of this embodiment 430 comprises a return spring 482, a centering rod 480, and a spring can 481 having an open end and a closed end. The return spring 482 is preferably an annular elastomeric Marsh Mellow™ spring disposed within the elastic spring can 481. The centering rod 480 passes completely through the center of this annular spring 482 and is coupled to a washer 486 at the opposite end of the spring 482. The end of the return spring 482 and the washer 486 at the end of the centering rod 480 are disposed within and abut the interior bottom of the spring can 481. As best seen in FIG. 30, the entire spring assembly 468, including the springs 481, 482, the washer 486 and the centering rod 480, is carried within a cavity 487 and a bore 488 within the rectangular support block 459 of the slide block 434. Therefore, the assembly 468 travels with the slide block 434. Although the spring can 481, like the rest of the assembly 468, is coupled to the support block 459, the closed end of the can 481 abutting the washer 486 extends from the cavity 487 and is disposed adjacent the inner wall 446 of one of the closed ends of the C-shaped bracket 439. The centering rod 480 is slidably disposed within the support block 459 with the end opposite the washer 486 extending from the support block 459 toward wall 447 of the other arm of the C-shape bracket 439.

During operation, as the ram travels downward, the slide block 434 travels to its extended position wherein the tool engages the workpiece (position illustrated in FIGS. 29 and 30), compressing the return spring 482 between the back wall 483 of the cavity in the rectangular support block 459 and the inner wall 446 of the C-shaped bracket 439. As the return spring 482 compresses, it exerts an opposing force on the slide block 434. Further, as the ram unit travels upward (i.e., towards the retracted position), the force of the return spring 482 along with the interaction of the safety return hook 494 with the ledge 497 tends to move the slide block 434 to the left along the keyed rails 448, 450. As best seen in FIG. 30, the slide block 434 will generally continue to move to the left until the centering rod 480 abuts the inner wall 447 of the C-shaped bracket 439. If the slide block 434 continues this movement, the slide block 434 also moves relative to the centering rod 480, the washer 486 at the end of the rod 480 stretching the bottom of the flexible spring can 481 outward. As a result of this stretching, the spring can 481 exerts a force which tends to move the slide block 434 in the opposite direction until the support block 459 contacts the wall 447.

It will be appreciated by those skilled in the art that any of the cam units discussed above can also be base mounted such that their driver assembly is mounted to the ram unit and their slide block is mounted to the lower die shoe without departing from the invention. Further, it will be appreciated that the functioning of the press cycle of the cam units are substantially the same whether configured as aerial cam units or base mounted cam units. For example, in the base mounted configuration, the driver assembly moves into contact with the slide block as the ram lowers. In response, the slide block compresses the return spring and moves in a direction transverse to the ram movement thereby bringing the attached tool into contact with a workpiece. The slide block remains in this transversely displaced position until the ram begins to rise. In addition, it will be appreciated that any of these base mounted cam units can also be used to provide angular variation to the horizontal plane of movement by incorporating the desired angle in the C-shape bracket 439. Heeling for the driver is incorporated in the C-shape bracket 439.

It should be noted that the above-described second, third and fourth embodiments 230, 330, 430 are preferred over the first embodiment 30 of the universal cam unit. The second, third and fourth embodiments 230, 330, 430 are all, however, equally preferred.

In summary, the invention provides a universal cam unit that may be easily assembled and disassembled within the press for die setting, maintenance, or modification. As indicated above, the universal cam unit comprises numerous components that are independently adjustable and replaceable. Thus, the components of the unit may be easily disassembled and reassembled to modify the unit for use with an alternate die set or to adjust the components to account for wear. It will thus be appreciated that the invention provides a versatile universal unit that standardizes the design of cam units, whether base mounted or aerial mounted, in that the unit may be adapted for use in more than a single application.

What is claimed is:

1. For use in a power press having a die set, a pressure pad unit which is movable relative to the die set to hold a workpiece therebetween, and a ram, a universal cam assembly having means for receiving a working tool for performing an operation on the workpiece, comprising, in combination:

a mounting bracket having a mounting structure and a gib, the mounting structure being fixedly attached to the power press, the gib being disposed beneath the mounting structure;

a slide block having an inclined cam bearing surface, a working surface and a slide block bracket, the slide block bracket slidably coupling the slide block to the gib of the mounting bracket to move between a retracted position and an extended position;

a driver assembly fixedly attached to the power press opposite the slide block, the driver assembly having an inclined driver bearing surface disposed substantially parallel to the inclined cam bearing surface such that when the cam bearing surface abuts the driver bearing surface, the cam bearing surface slides along the driver bearing surface and the slide block moves between the retracted and the extended positions; and, a spring assembly disposed within the gib for returning the slide block as the slide block moves between the retracted and extended positions, the spring assembly including a first stop block disposed at a first end of the gib; a second stop block disposed at a second end of the gib opposite the first stop block; a return spring disposed adjacent the first stop block; a damping spring disposed adjacent the second stop block; and a compression arm disposed between the return spring and the damping spring, the compression arm being attached to the slide block for movement therewith such that the compression arm compresses the return spring against the first stop block as the slide block moves from the retracted position to the extended position and the compression arm compresses the damping spring against the second stop block as the slide block moves from the extended position to the retracted position.

2. A universal cam unit as defined in claim 1 further comprising a mounting wedge disposed between the mounting bracket and the power press for adjusting the angular position of the inclined cam bearing surface.

3. A universal cam unit as defined in claim 1 wherein the mounting structure and the gib are integrally formed.

4. A universal cam unit as defined in claim 1 wherein the slide block bracket has a U-shaped cross-section and includes removable retaining stops for removably attaching the slide block to the gib.

5. A universal cam unit as defined in claim 4 wherein the slide block bracket includes removable wear plates slidably disposed adjacent the gib.

6. A universal cam unit as defined in claim 1 wherein the return spring comprises at least one elastomeric spring.

7. A universal cam unit as defined in claim 1 wherein the return spring comprises at least one coil spring.

8. A universal cam unit as defined in claim 1 wherein the spring assembly further comprises a third stop block removably attached to the second stop block for limiting the slide block movement.

9. A universal cam unit as defined in claim 1 wherein the damping spring comprises at least one elastomeric spring.

10. A universal cam unit as defined in claim 1 wherein the damping spring comprises at least one coil spring.

11. A universal cam unit as defined in claim 1 further comprising a spacer removably attached to the compression arm for adjusting the travel of the slide block.

12. A universal cam unit as defined in claim 1 further comprising a centering rod extending through the return spring, the damping spring and the compression arm for maintaining the spring assembly in alignment.

13. A universal cam unit as defined in claim 1 further comprising a safety return mechanism for ensuring that the slide block returns from the extended position to the retracted position.

14. A universal cam unit as defined in claim 13 wherein the safety return mechanism comprises a first stripper guide hook coupled to the driver and a second stripper guide hook coupled to the slide block, the first and second stripper guide hooks operatively engaging when the slide block is in the extended position to return the slide block to the retracted position when the ram moves to open the die set.

15. A universal cam unit as defined in claim 1 wherein the inclined cam bearing surface and the inclined driver bearing surface are substantially flat.

16. A universal cam unit as defined in claim 1 wherein the inclined cam bearing surface and the inclined driver bearing surface have a substantially V-shape.

17. A universal cam unit as defined in claim 1 further comprising a working tool coupled to the means for receiving a working tool for performing an operation on the workpiece, the working tool extending from the working surface of the slide block toward the workpiece such that as the slide block moves from the retracted position to the extended position the working tool engages the workpiece to perform an operation thereon.

18. For use in a power press having a die set, a pressure pad unit which is movable relative to the die set to hold a workpiece therebetween, and a ram, a universal cam assembly having means for receiving a working tool for performing an operation on the workpiece, comprising, in combination:

a mounting bracket fixedly attached to the power press, the mounting bracket having two oppositely disposed closed sides and two oppositely disposed open sides, and further including rails forming inwardly directed ledges, the rails being attached to the oppositely disposed open sides of the mounting bracket such that the mounting bracket and the rails define a channel;

a slide block slidably coupled to the inwardly directed ledges of the mounting bracket to move between a retracted position and an extended position, the slide block having an inclined cam bearing surface and a working surface and further including a support block slidably disposed within the channel defined by the mounting bracket and the rails;

a spring assembly disposed within the support block, the spring assembly including a return spring attached to the support block for movement therewith, the return spring being positioned for compression between the support block and a first one of the closed sides of the mounting bracket as the slide block moves from the retracted position to the extended position, the spring assembly further including a spring can having a top and a bottom with the return spring being disposed within the spring can, a washer disposed within the spring can between the return spring and the bottom of the spring can, and a rod attached to the washer and extending beyond the top of the spring can for contacting a second one of the closed sides of the mounting bracket when the slide block moves from the extended position to the retracted position such that the spring can exerts a force directed opposite to the movement of the slide block; and, a driver assembly fixedly attached to the power press opposite the slide block, the driver assembly having an inclined driver bearing surface disposed substantially parallel to the inclined cam bearing surface such that when the cam bearing surface abuts the driver bearing surface, the cam bearing surface slides along the driver bearing surface and the slide block moves between the retracted and the extended positions.

19. A universal cam unit as defined in claim 18 wherein the slide block includes keyports for slidably engaging the inwardly directed ledges of the rails.

20. A universal cam unit as defined in claim 18 wherein the rails and the mounting bracket are integrally formed.

21. A universal cam unit as defined in claim 18 wherein the slide block and the support block are integrally formed.

22. A universal cam unit as defined in claim 18 further comprising a wear plate disposed between the mounting bracket and the support block.

23. A universal cam unit as defined in claim 18 wherein the support block is rectangular.

24. A universal cam unit as defined in claim 18 wherein the return spring comprises at least one elastomeric spring.

25. A universal cam unit as defined in claim 18 further comprising a mounting wedge disposed between the mounting bracket and the power press for adjusting the angular position of the inclined cam bearing surface.

26. A universal cam unit as defined in claim 18 further comprising a safety return mechanism for ensuring that the slide block returns from the extended position to the retracted position.

27. A universal cam unit as defined in claim 26 wherein the safety return mechanism comprises a stripper guide hook coupled to the driver and a ledge in the slide block, the stripper guide hook operatively engaging the ledge when the slide block is in the extended position to return the slide block to the retracted position when the ram moves to open the die set.

28. A universal cam unit as defined in claim 18 wherein the inclined cam bearing surface and the inclined driver bearing surface are substantially flat.

29. A universal cam unit as defined in claim 18 wherein the inclined cam bearing surface and the inclined driver bearing surface have a substantially V-shape.

30. A universal cam unit as defined in claim 18 further comprising a working tool coupled to the means for receiving a working tool for performing an operation on the workpiece, the working tool extending from the working surface of the slide block toward the workpiece such that as the slide block moves from the retracted position to the extended position the working tool engages the workpiece to perform an operation thereon.

* * * * *